US006123174A

United States Patent [19]

Elkin et al.

[11] Patent Number: 6,123,174

[45] Date of Patent: Sep. 26, 2000

[54] APPARATUS AND METHOD FOR AUTOMATICALLY PERFORMING FLUID CHANGES

[75] Inventors: Peter M. Elkin, Irvine, Calif.; John Workings, Albuquerque, N. Mex.; David Azarewicz, Tucson, Ariz.; Richard R. Roy, Anaheim, Calif.; Paul M. Elkin, deceased, late of Rancho Santa Margarita, Calif., by Estelle Elkin, executrix

[73] Assignee: AS2000, LLC, Irvine, Calif.

[21] Appl. No.: 08/966,615

[22] Filed: Nov. 10, 1997

Related U.S. Application Data

[63] Continuation-in-part of application No. 08/723,497, Sep. 30, 1996, Pat. No. 5,685,396, and a division of application No. 08/468,285, Jun. 6, 1995, Pat. No. 5,562,181.

[51] Int. Cl.[7] ..... F16N 7/14

[52] U.S. Cl. ..... 184/1.5; 123/196 S; 141/65

[58] Field of Search ..... 184/1.5; 123/196 A, 123/196 R, 196 S; 141/65, 83, 192

[56] References Cited

U.S. PATENT DOCUMENTS

| | | | |
|---|---|---|---|
| 1,815,221 | 7/1931 | Sweetland . | |
| 2,320,048 | 5/1943 | Parson | 184/1.5 |
| 2,552,749 | 5/1951 | Tabet | 184/1.5 |
| 3,216,527 | 11/1965 | Lewis | 184/1.5 |
| 3,720,287 | 3/1973 | Martel | 184/1.5 |
| 3,810,487 | 5/1974 | Cable et al. | 137/351 |
| 4,095,672 | 6/1978 | Senese | 184/1.5 |
| 4,095,673 | 6/1978 | Takeuchi | 184/1.5 |
| 4,193,487 | 3/1980 | Takeuchi | 184/1.5 |
| 4,869,346 | 9/1989 | Nelson | 184/1.5 |
| 4,938,315 | 7/1990 | Ohta et al. | 184/1.5 |
| 5,273,085 | 12/1993 | Edwards et al. | 141/98 |
| 5,343,906 | 9/1994 | Tibbals, III | 141/83 |
| 5,351,725 | 10/1994 | Suthergreen et al. | 141/83 |
| 5,372,219 | 12/1994 | Peralta | 123/196 S |
| 5,423,457 | 6/1995 | Nicholas et al. | 141/83 |
| 5,472,064 | 12/1995 | Vikew | 184/1.5 |
| 5,491,631 | 2/1996 | Shirane et al. | 364/424.04 |
| 5,535,849 | 7/1996 | Few | 141/98 |
| 5,544,683 | 8/1996 | Guhl | 141/65 |
| 5,586,583 | 12/1996 | Edwards et al. | 184/1.5 |
| 5,605,182 | 2/1997 | Oberrecht et al. | 141/94 |
| 5,694,989 | 12/1997 | Kupelian | 141/65 |
| 5,787,372 | 7/1998 | Edwards et al. | 184/1.5 |
| 5,853,068 | 12/1998 | Dixon et al. | 184/1.5 |

FOREIGN PATENT DOCUMENTS

| | | | |
|---|---|---|---|
| 2548365 | 4/1976 | Germany | 184/1.5 |
| 0016115 | 1/1988 | Japan | 184/1.5 |
| 0057808 | 3/1988 | Japan | 184/1.5 |

*Primary Examiner*—David A. Bucci
*Assistant Examiner*—Chong H. Kim
*Attorney, Agent, or Firm*—Klein & Szekeres, LLP

[57] ABSTRACT

An environmentally sound apparatus and method for automatically extracting fluids such as lubricating fluids from a target reservoir such as a crankcase for a vehicle engine, and injecting the proper type and quantity of fresh fluid into the reservoir is disclosed. The apparatus includes one or more sources of lubricating fluid, a waste fluid tank, a pump, and a flow meter. A programmed microprocessor produces selected sequences of control signals to govern the flow of fluid among the fluid sources, the waste fluid tank, and the target reservoir in response to input identification information and signals produced by a flow monitoring pulse meter. Input identification information is compared with data in a stored database to determine the correct type and quantity of fresh fluid to inject. Operator identification information is compared with a stored operator database to determine what operations each operator is permitted to perform. A display and selection switches allows the operator to select from different procedure options. Evacuation, injection and clearing operations are initiated by an operator and executed automatically through status monitored sequences controlled by the microprocessor. All fluid exchange sequences are performed without exposing the operator or the environment to either waste or fresh fluid.

21 Claims, 31 Drawing Sheets

PRESS START
(102)
ADD OIL QTY ENTERED ?
NO
SIGNAL OPERATOR TO ENTER QTY.
YES
(41a,41b)
FRESH OIL LOW ?
YES
ERROR
NO
(43)
AIR PRESSURE LOW ?
YES
ERROR
NO
(131)
BATTERY VOLTAGE LOW ?
YES
ERROR
NO
INJECT SEQUENCE
TURN GREEN LED ON
(110)
SOUND BUZZER
(93)

PRESS START
(102)
(43)
AIR PRESSURE LOW ?
YES
ERROR
NO
(131)
BATTERY VOLTAGE LOW ?
YES
ERROR
NO
CLEAR SEQUENCE
TURN GREEN LED ON
(110)
SOUND BUZZER
(93)

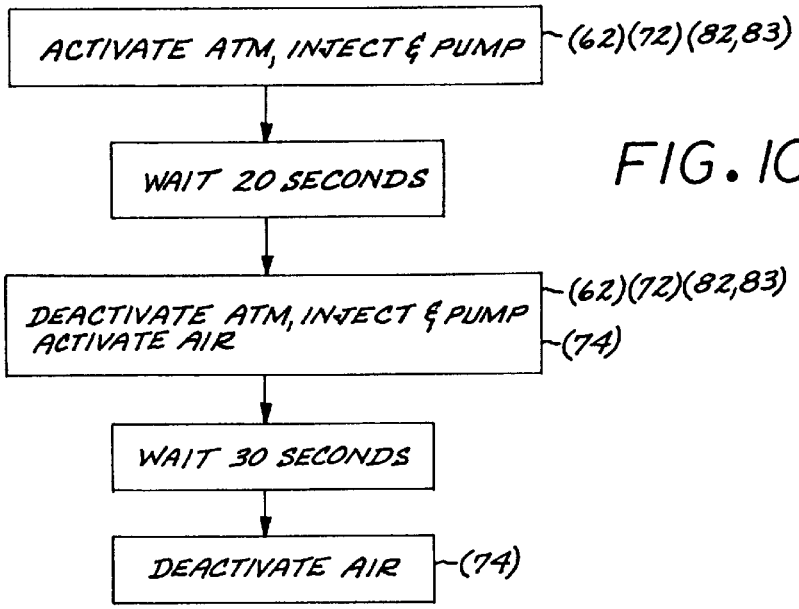
FIG. 10
FIG. 11
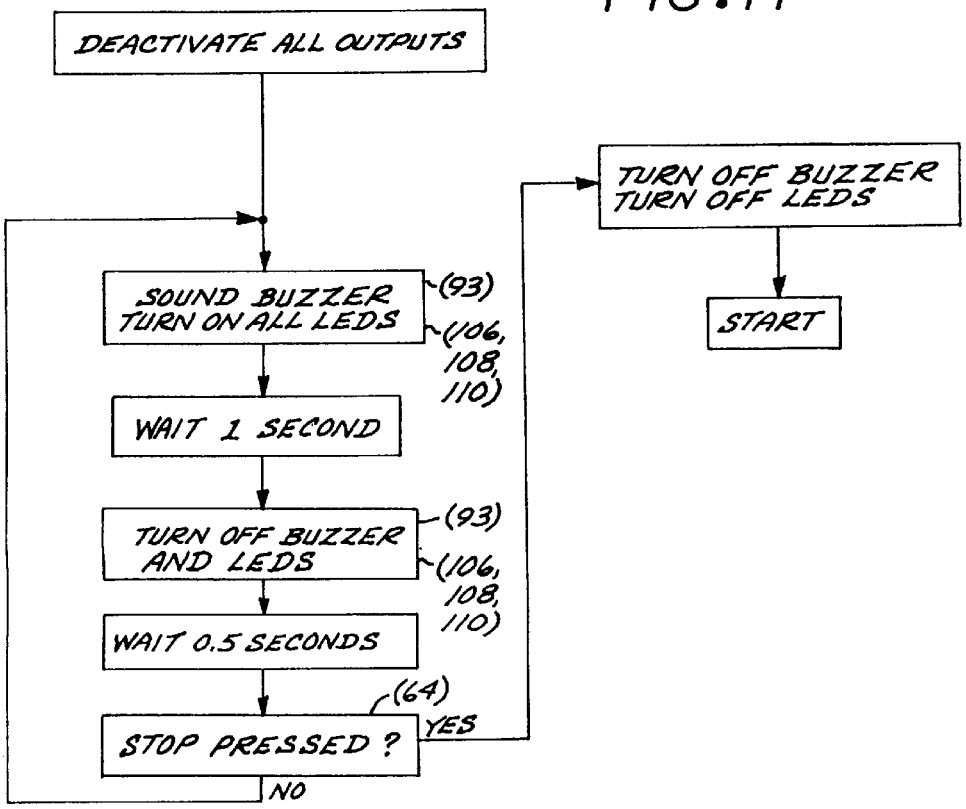

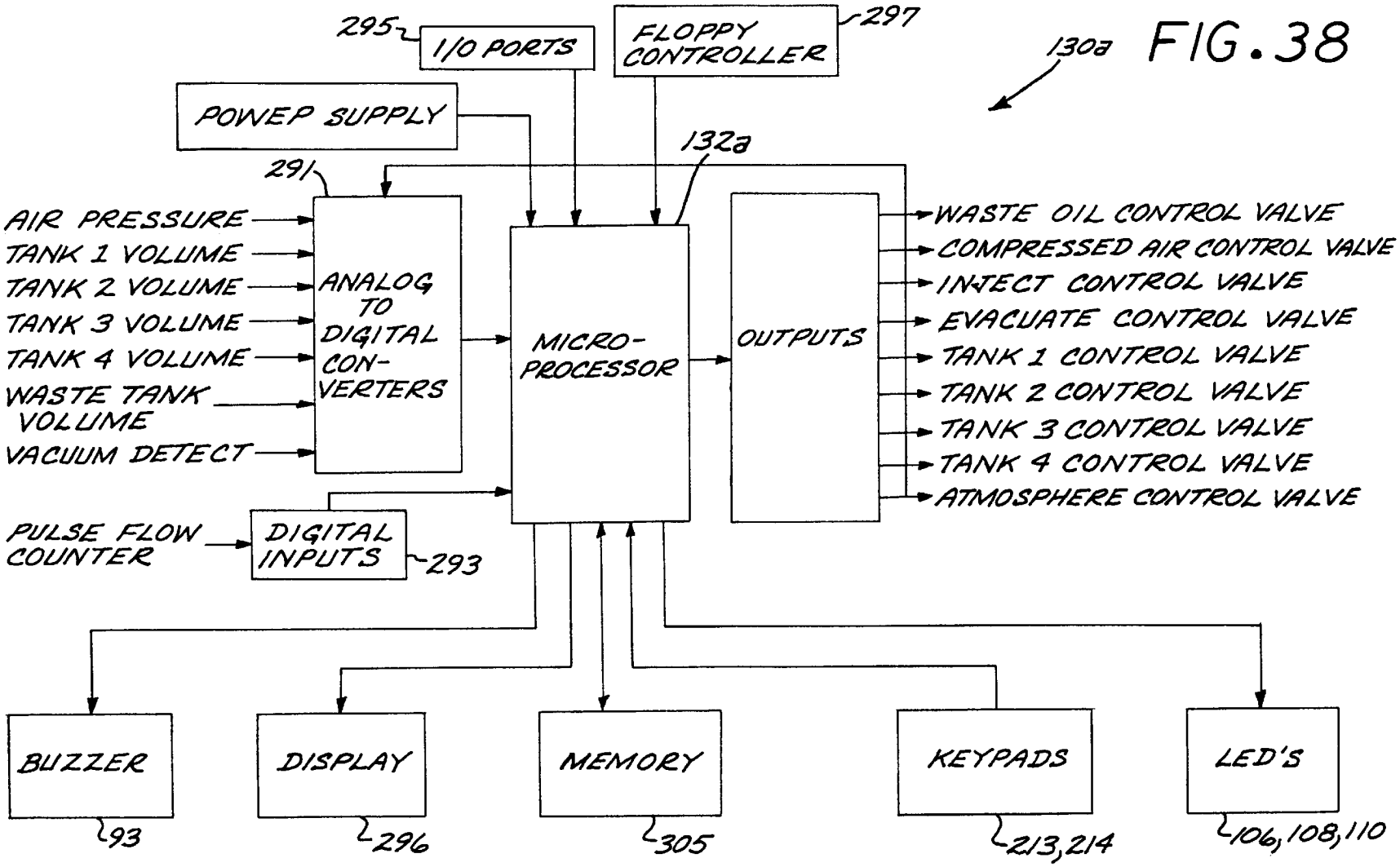
FIG. 38
130a
WASTE OIL CONTROL VALVE
COMPRESSED AIR CONTROL VALVE
INTECT CONTROL VALVE
EVACUATE CONTROL VALVE
TANK 1 CONTROL VALVE
TANK 2 CONTROL VALVE
TANK 3 CONTROL VALVE
TANK 4 CONTROL VALVE
ATMOSPHERE CONTROL VALVE
OUTPUTS
297
FLOPPY CONTROLLER
132a
MICRO-PROCESSOR
295
I/O PORTS
POWER SUPPLY
291
ANALOG TO DIGITAL CON-VERTERS
293
DIGITAL INPUTS
AIR PRESSURE
TANK 1 VOLUME
TANK 2 VOLUME
TANK 3 VOLUME
TANK 4 VOLUME
WASTE TANK VOLUME
VACUUM DETECT
PULSE FLOW COUNTER
LED'S
106, 108, 110
KEYPADS
213, 214
MEMORY
305
DISPLAY
296
BUZZER
93

APPARATUS AND METHOD FOR AUTOMATICALLY PERFORMING FLUID CHANGES

CROSS-REFERENCE TO RELATED APPLICATIONS

This application is a Continuation-in-Part of copending application Ser. No. 08/723,497; filed Sep. 30, 1996; issued Nov. 11, 1997 as U.S. Pat. No. 5,685,396. Application Ser. No. 08/723,497, in turn, was a Division of application Ser. No. 08/468,285; filed Jun. 6, 1995; issued Oct. 8, 1996 as U.S. Pat. No. 5,562,181.

BACKGROUND

1. Field of the Invention

The present invention relates generally to the field of apparatus and methods for changing motor oil in internal combustion engines. More specifically, the invention relates to a computer-controlled, mobile system for removing used oil from a vehicle engine, supplying the engine with fresh oil, and purging the system of residual oil, all in an environmentally protective manner.

2. Description of Related Art

Metal parts that make contact with one another within internal combustion engines are lubricated by lubricants, generally called "motor oils", which must be replaced at regular intervals to optimize engine performance and to prevent damage or malfunction from abrasive or corrosive contaminants in the lubricant. Traditionally, the task of replacing used motor oil with fresh motor oil has involved: 1) manually removing a crankcase oilpan plug from beneath an engine; 2) gravity draining the used oil into a receptacle exposed to the ambient environment; and 3) refilling the crankcase by gravity through an oil filling port, either from a number of small containers, or from a fresh oil bulk dispensing tank or barrel.

This operation is often messy, time consuming, and environmentally unsound, exposing the used oil to the environment. Furthermore, changing oil in this manner often leaves a substantial residual quantity of used oil in the crankcase, since the gravity draining is inefficient, especially if the used crankcase oil has become excessively thickened due to overlong use. Still further, both the filling and draining operations often expose service station personnel to contact with the oil, an occurrence that is perceived to pose some health risks, especially in connection with used oil.

Various attempts have been made in the prior art to render the foregoing task less messy, less time-consuming, less environmentally hazardous and generally safer and more convenient. Most of these attempts have employed some form of suction device to extract the used oil, and some have also provided for a pressurized injection of fresh oil. The various prior art oil changing systems, however, suffer from one or more drawbacks, such as inadequate or nonexistent automation, lack of mobility, poor internal system safety checks, or the inability to directly monitor and/or control the quantity of oil extracted or supplied.

For example, U.S. Pat. No. 3,216,527—Lewis discloses an engine crankcase oil changing system that employs suction for oil extraction, and pressurized air for supplying fresh oil through the dipstick tube of the engine. This system requires the permanent installation of some parts on the engine itself, and it employs separate devices for vacuum generation and for pressurizing the fresh oil flow.

There is no measurement of the quantity of spent oil extracted, nor are safety checks provided during any of the operations.

U.S. Pat. No. 3,810,487—Cable et al. discloses a truck mounted mobile oil changing system that employs air pressure to inject fresh oil into an engine's crankcase. While the system is capable of supplying a plurality of engine fluids from multiple sources, both mounted on the truck and remote from it, there is no significant degree of automation. Spent oil is drained from the vehicle by gravity flow into a waste oil receptacle, exposing the spent oil to the environment.

U.S. Pat. No. 5,372,219—Peralta discloses a reversible pump driven system for extracting and adding motor oil to an engine, employing a single multiway valve for directing fluid flow. The system is mounted within the engine compartment of the vehicle, and thus can be used only for the engine in that vehicle. There is no provision for measuring fluid flow, and thus no part of the extraction or refilling process is automated on the basis of the volume of the oil delivered or removed. Nor are there any built-in safety means for automatically checking fluid levels in supply tanks or waste tanks, or for testing for vacuum presence or low voltage level, during operation of the system.

There has thus been a long-felt, but as yet unfilled need for an engine oil changing system that employs a single pump to both extract used oil and to inject fresh oil, and the automatically and directly measures fluid flow both into and out of the engine in real time to control both the filling and extraction functions. There is a further need for such an oil changing system that can be made either mobile or stationary, and that performs the entire oil exchange operation without exposure of the oil to the environment, and without exposing the operator to the used oil. There is a still further need for such an oil changing system that incorporates computer controlled operational and safety checks and automated error messages to assure the efficient and successful completion of the oil exchange operation.

SUMMARY OF THE INVENTION

It is an object of this invention to provide a method and apparatus for automatically changing engine fluid that overcome the foregoing deficiencies.

It is a further object to provide a mobile, computer controlled, single pump oil exchange apparatus that directly measures fluid quantity in real time during both evacuation from and injection into an engine, and automatically feeds back such real time measurements to determine system operation.

It is another object to provide apparatus and method that performs engine oil exchange with no contact of the oil with an operator and no exposure of the oil to the environment.

It is yet another object to provide such an oil change system incorporating substantial computer controlled operational and component status checks and error messages to assure efficient and successful completion of the oil transfer functions.

It is another object of this invention to provide an apparatus and method that performs a fluid exchange operation with a high degree of automation.

It is a further object to provide an apparatus and method that performs an oil exchange operation that automatically determines from a stored database the type and quantity of oil to inject, to minimize the possibility of supplying an erroneous type or quantity of oil to the engine.

It is a further object to provide a method of inventory control for fresh oil used in engine oil exchange operations by storing information relating to oil exchange operations conducted.

It is yet another object to provide a system and method for accounting for waste oil removed during engine oil exchange operations.

The present invention involves a mobile computer-controlled apparatus and method for changing lubricating fluid in an internal combustion engine. The apparatus and method is for use with an engine having a crankcase oil pan with a threaded drain opening and a dipstick measuring tube. It includes a container module housing one or more fresh oil tanks and at least one waste oil tank as well as fluid level-sensing status switches and a source of atmospheric air. Signals from such switches and from sensors for compressed air pressure, vacuum, and battery voltage are relayed to a central processing unit that is located in a service module installed adjacent to the container module.

Also within the service module is a network of valve-controlled lines in fluid communication with 1) an external source of compressed air, 2) the container module tanks and a source of atmospheric air, and 3) a reel hose connected via a selected one of a group of connector lines to the engine oil pan. For example, one connector line is adapted for use with a replacement plug fitted into the threaded drain opening of the oil pan, while a different connector line is adapted for insertion into the engine dipstick tube. A single pump within the service module drives fresh oil, waste oil and air through the system. The network of lines and valves is arranged so that each such fluid in turn courses through the pump in the same direction, and is routed to and from different locations by the automatic opening and closing of appropriate valves.

The flow of both fresh oil and waste oil is continuously monitored by a pulse flow meter. Signals from the pulse flow meter and from the previously mentioned status switches and sensors are relayed to the central processor unit which operates through a service module front control panel to control the pump and valves, and to display indications of system performance to an operator.

In operation, an operator initializes the computer (central processor unit) from the front control panel by selecting a fresh oil tank and setting a quantity of oil to be evacuated from and/or injected into the crankcase oil pan. The operator then chooses either fully automatic operation or one or more manual operations with automated sequences.

If fully automatic operation has been selected, the computer commences status checks for low fresh oil, full waste tank, low compressed air pressure, low battery voltage, and presence of subatmospheric pneumatic pressure (vacuum) in a pump input line, displaying appropriate error messages for operator attention as necessary. If all status checks are normal, the computer executes an evacuation sequence, extracting quantity-monitored spent oil from the crankcase, and then executes an injection sequence (including a clear sequence), injecting quantity-monitored fresh oil. The computer then signals the operator through audible and visible control panel indicators that the operation is complete.

If only evacuation is desired, the operator selects Manual-Evacuate. The computer initializes oil quantity to zero, performs all status checks except "low fresh oil", executes the same evacuation sequence referenced above for automatic operation, and signals completion of the Manual-Evacuate operation. If only injection is desired, the operator selects Manual-Inject. The computer checks for oil quantity initialization and pauses the system for operator input if no initialization has occurred. All status checks except "waste tank full" are performed, and the same injection sequence referenced for automatic operation is performed, followed by the completion indications.

If only clearance of the system lines is desired, the operator selects Manual-Clear. The computer checks for low air pressure and low battery voltage, then performs the same clear sequence referenced for automatic operation, signalling completion when done.

These and other features of the present invention will become apparent from the following Detailed Description of an Exemplary Embodiment when taken in conjunction with the claims and drawing figures herein described.

The apparatus and method of the present invention evacuates fluid from a target receptacle, and supplies fresh fluid to that target receptacle.

According to the method of the invention, a conduit is connected to the target receptacle. Fluid is evacuated from the target receptacle through the conduit by applying sub-atmospheric pressure to the target receptacle through the conduit. The evacuation is stopped when a predetermined condition is satisfied. The predetermined condition may be that essentially all fluid has been removed from the target receptacle, or a predetermined amount of fluid has been removed from the target receptacle. A source receptacle of fresh fluid is connected to the conduit. Fresh fluid from the source receptacle is injected into the target receptacle through the conduit. At least periodically the volume of fluid injected into the target receptacle is measured, and that measured value is compared with a preset injected volume value. The injection step is stopped when the measured injected value substantially equals the preset injected volume value.

The system of the present invention for evacuating fluid from and/or injecting fluid into a first receptacle includes waste path connected to a waste tank, and a source path connected to a source tank containing fresh fluid. A series of conduits connects the source path and the waste path to the first receptacle. The fluid flow through the conduits is controlled by a plurality of electrically controlled valves. A pump selectively produces sub-atmospheric pressure in the conduits. A flow meter produces a flow signal indicative of the volume of fluid flowing through the conduits. The system additionally includes a data input port for receiving data, and a microprocessor programmed to produce selected sequences of control signals to the pump and to the electrically controlled valves in response to the flow singal and to data received at the data input port. The data received at the data input port includes identification information identifying the first receptacle, and the system additionally includes a database for correlating the identification information with a predetermined set of the sequences of control signals. The system automatically determines from a stored database the type and quantity of fluid to be injected from such identification information. In addition, the data may include operator identification information. The system apparatus selectively permits access to different ones of its sequences or procedures based upon the entered operator identification information.

BRIEF DESCRIPTION OF THE DRAWINGS

FIG. 10 is a block diagram illustrating the automatic CLEAR Sequence steps from the Manual Clear operation of FIG. 7.

FIG. 11 is a block diagram illustrating the automatic ERROR Sequence steps from the Automatic operation of FIG. 4.

FIG. 38 is a functional block diagram illustrating major subcircuits of the Central Processing Unit of FIG. 16.

DETAILED DESCRIPTION OF AN EXEMPLARY EMBODIMENT

Figures 1, 1A:
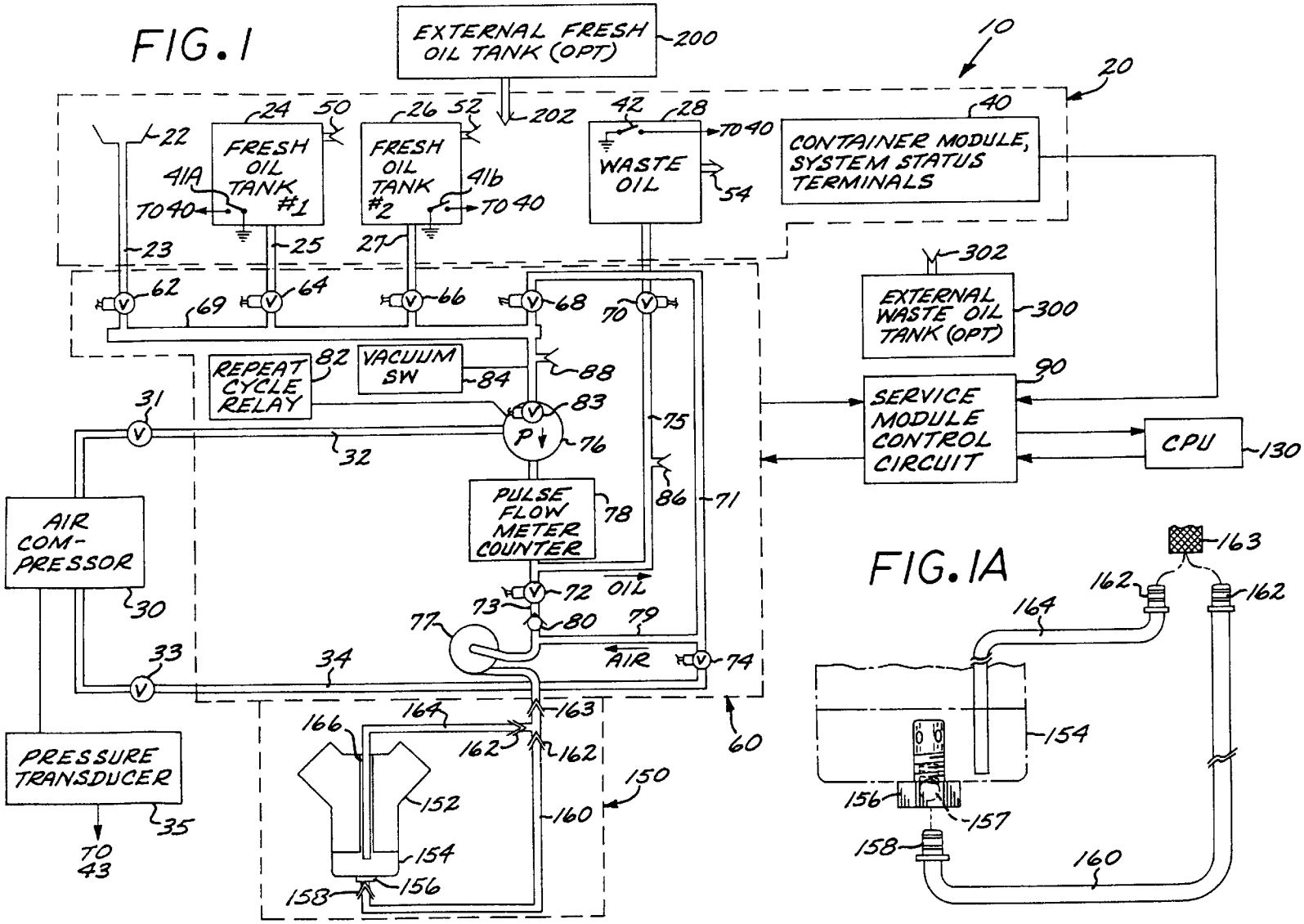
FIG. 1 is a pictorial diagram of a computer controlled lubricating oil extraction and injection apparatus illustrating fluid flow and control features of the present invention.
FIG. 1A is an enlarged pictorial view illustrating details of connector and connector line elements of the apparatus of FIG. 1

An overview of an embodiment of the present invention is presented in FIG. 1, wherein a mobile, computer controlled apparatus 10 for changing oil is illustrated.

Structural Arrangement

The physical configuration of the apparatus 10 will be described in this section, as necessary foundation for the operational control and fluid flow description to follow in the next section. Two major modules, a container module 20 and a service module 60 are integrated to perform vacuum evacuation and pressure injection of lubricating fluid in a safety monitored and environmentally sound automated process. Three identical service modules 60, 60*a* and 60*b* may be installed side side and forward of a container module 20 in an enclosure 170 (FIG. 15) and mounted in a van or truck (not shown). To facilitate undoing of the present invention, the configuration and operation of a single service module 60 will be discussed, with the understanding that the discussion applies equally to the other service modules 60, 60*a*, 60*b* in the system.

The container module 20 includes three fluid sources which supply oil or air to the service module 60, and one waste oil tank 28 which receives spent oil from service module 60. Two of the three sources are first and second fresh oil tanks 24 and 26 respectively, and the third is a hopper 22 open to atmospheric air. The sources 22,24,26 are connected by conduits 23, 25 and 27 respectively, to valves and a aft manifold in service module 60. The conduit 23 is an atmospheric air conduit, while the conduits 25 and 27 are first and second fresh oil conduits, respectively.

Figure 2:
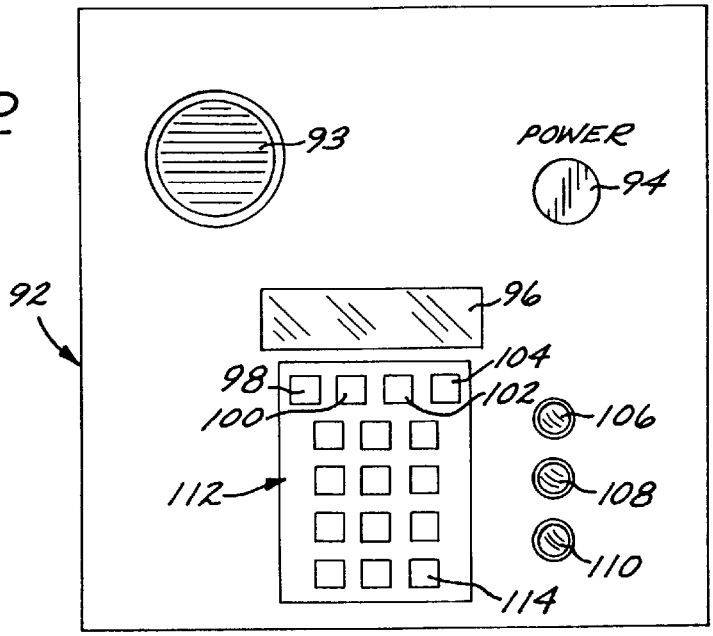
FIG. 2 is a front elevation view of a control panel of the present invention illustrating a functional layout of switches and indicators.

The waste tank 28 is supplied from the service module 60 through a conduit 75. The container module 20 also includes a number of status monitoring switches providing alarm signals to an associated status terminal board (to be described in conjunction with FIG. 13) within the container module 20, and a cable for providing the alarm signals to a central processing unit 130 physically mounted on the rear side of a service module front panel 92 (FIG. 2).

The service module 60 houses the lines through which oil and air fluids are channeled, a single pump 76 for propelling such fluids, a pulse flow meter 78 to measure and report the flow of fluid oil for both injection and evacuation operations, a vacuum switch 84 to assure counter 78 operation only when fluid is flowing in pump 76, valves to direct fluid flow for the various operations of the system apparatus, and a central processing unit (CPU) 130 working through service module control circuits 90 and control panel 92 to automatically control the valves and pump action. The rate of flow as signalled by the pulse flow meter 78 is relayed to the CPU 130 where flow rate input is integrated to produce volumetric quantity data proportional to the flow rate input. Volume measurements are displayed in quarts or liters to the nearest tenth on the Display window 96.

The novel design of the fluid lines advantageously allows the use of only one pump 76, propelling fluids in just one direction, to perform both vacuum extraction and pressure injection functions, as well as the clearing of the system for subsequent activity. Pump 76 may be, for example, a compressed air actuated diaphragm pump as supplied by Weldin Company of Riverside, Calif., having a ten GPM capacity and an internal 12 Volt DC solenoid-switched valve 83. The pump valve 83 is controlled by a repeat cycle relay 82, seen in more detail in FIG. 12, which permits the pump 76 to have preset "on" and "off" times and to run at a constant preselected rate, while preventing fluid cavitation when the pump is dry.

An air compressor 30, which may be mounted within a transport van adjacent to the cabinet that houses the service modules 60 and container module 20 , supplies compressed air through a pump air supply line 32 to actuate the pump 76, and also through a purge/evacuation line 34 to clear the system as will be described later. The compressor 30 may deliver 80 to 120 psi pressure, with 60 psi considered to be an unacceptably low level reportable to the CPU 130 as an alarm signal.

Fluid input to the pump 76 comes directly from an input manifold 69, is monitored by the vacuum switch 84, and exits the pump 76 where its volume of flow is measured by the flow meter 78. The pulse flow meter 78 counts one pulse for each one-tenth of a quart of fluid flow, and relays the count to the CPU 130 for comparison with preselected quantity input from a keypad 112 on the control panel 92 (FIG. 2). A suitable pulse flow meter 78 is, for example, a Model 84458 from the Lincoln Company of St Louis, Mo. The flow meter 78 may also be calibrated for deciliter volumetric pulse, where metric volume units are employed.

The manifold 69 accepts input from the container module 20 through the air conduit 23 and fresh oil conduits 25 and 27, controlled by valves 62,64 and 66 respectively. All fluid conduit valves in the service module 60 are 12 Volt DC two way direct acting solenoid valves of the type PAGP400G23MM12D supplied by Parker-Hannefin of Elyria, Ohio.

An evacuation conduit 71 completes the input set to the manifold 69, and is controlled by an evacuation control valve 68.

Fluid output from the pump 76 and the flow meter 78 branches in one of two directions: either into an injection control valve 72 controlling an injection conduit 73, or into a waste conduit 75 leading to the waste oil tank 28 and controlled by a waste flow control valve 70. After flowing through the injection control valve 72, fluid in the injection conduit 73 flows through a check valve 80, and then branches again either directly into a reel hose 77 leading out ultimately to an engine 152, or into the pump input manifold 69 through the evacuation line 71 and the evacuation control valve 68 previously described.

The last fluid line internally connected within the service module 60 is purge/evacuation air line 34, controlled by a compressed air control valve 74, and connected to both the reel hose 77 downstream from the check valve 80 and to the evacuation line 71 upstream from the evacuation control valve 68.

A source 200 of new oil and a reservoir 300 for spent oil, both external to the truck or van transporting the apparatus 10, may optionally be connected to the service module 60. The external oil source 200 may be connected, via a first gate valve 202, to either of the new oil fluid flow lines 25 or 27 upstream from valves 64 or 66, respectively, and the external waste oil reservoir 300 may be similarly connected via a second gate valve 302 to the waste oil line 75 downstream from the waste oil control valve 70.

Fluid flow between service module 60 and engine 152 takes place through the reel hose 77, which has a quick-disconnect fitting 163 at its free end. Access to the engine oil pan 154 for either evacuation or injection is achieved through one of two types of quick-disconnect connector lines shown in FIG. 1A. A hose connector line 160 is used in conjunction with a valved replacement drain plug 156. The hose connector line 160 has a proximal end fitting 162 that is inserted into the replacement plug 156. For access from above oil pan 154, a plastic tubing connector line 164 has a proximal end fitting 162, identical to the hose connector line fitting 162, which mates with the reel hose quick-disconnect fitting 163. The distal end of the tubing 164 connector line is worked into and through a dipstick measuring tube 166 to reach the oil pan 154. The tubing 164 may be, for example, an approximately 36" (one meter) length of polypropylene material having an inner diameter of from ⅛" to 3⁄16" (approximately 0.32 cm).

It will be appreciated from the foregoing discussion that the physical flow of fluid oil is conducted in an entirely closed system, involving no environmental exposure to waste or fresh oil. Once either of the connector lines 160 or 164 is in place, spent oil from the oil pan 154 is evacuated through the reel hose 77, the evacuation line 71, the pump 76 and the waste line 75 to waste tank 28 without any oil contact with an operator or any external spillage. Similarly, fresh oil is injected from tanks 24 or 26 through the manifold 69, the pump 76 and the injection line 73 to the reel hose 77 and out to the engine 152 in a fully contained, environmentally isolated passage. It should also be apparent that access from the reel hose 77 to the oil pan 154 may be gained through a typical oil filler channel (not shown) via any suitable oil filler cap connector for both evacuation and injection of oil.

Figure 15:
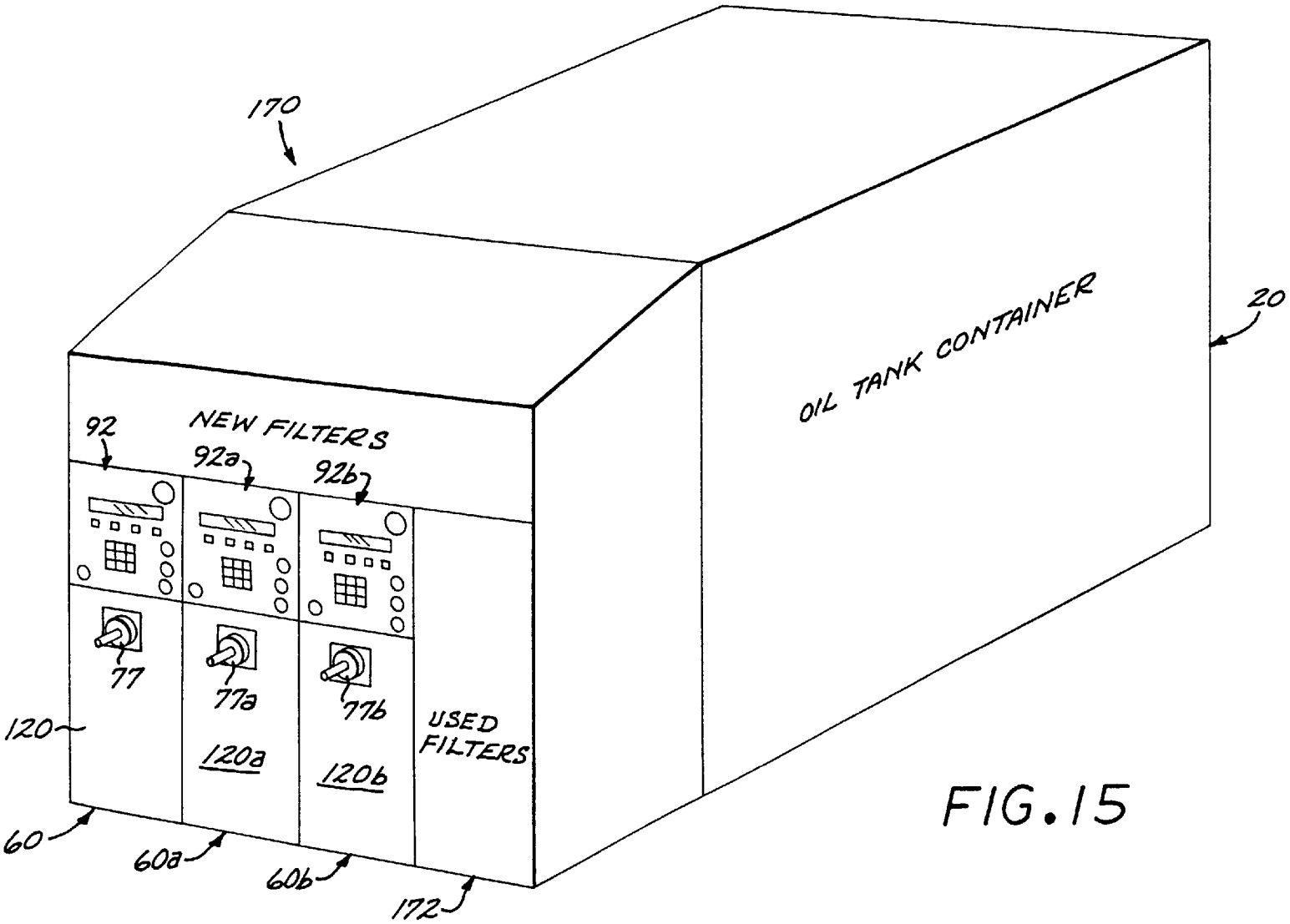
FIG. 15 is a pictorial perspective view of an assembled mobile unit illustrating the placement of modules in an exemplary embodiment of the present invention.

FIG. 15 presents a view of a typical truck or van configuration of the system apparatus 10 installed in an enclosure 170. Two additional service modules, 60A and 60B are mounted adjacent the service module 60 and forward of the container module 20. A storage compartment adjacent the service module 60B may be used for the storage of used oil filters. Front control panels 92, 92A and 92B are shown above reel hose panels 120, 120A and 120B respectively.

The air compressor 30 is not shown in FIG. 15, but is mounted conveniently behind the enclosure 170 in a position not critical to the present invention. Details of the front control panel 92 are shown in FIG. 2 and will be discussed below. While the service module control circuitry 90 and the CPU 130 (FIG. 1) are contained in the service module 60, they are shown outside the fluid flow (dashed lines) box of the service module 60 in FIG. 1 to distinguish electrical signal inputs and outputs from fluid flow lines.

Figure 12:
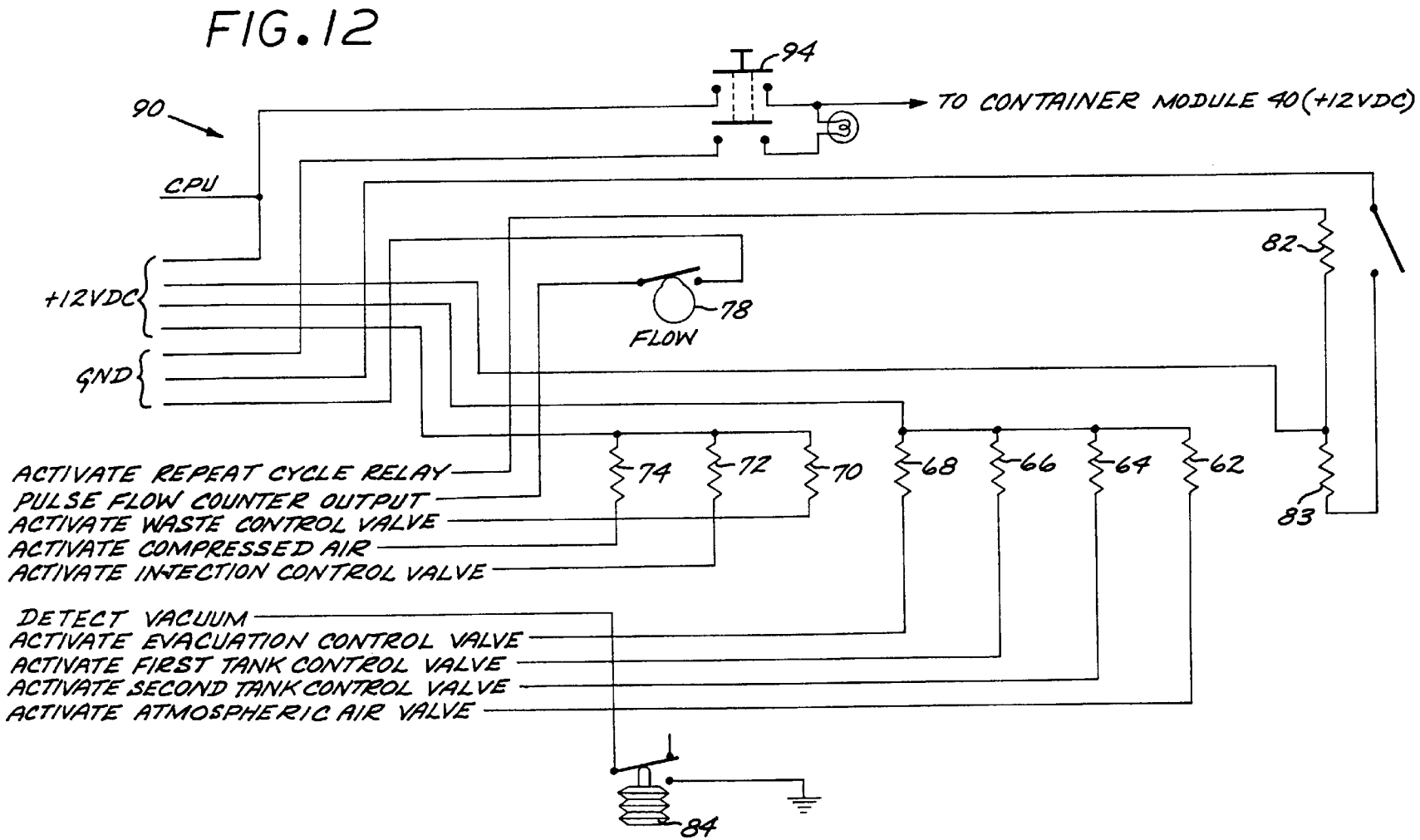
FIG. 12 is a schematic diagram illustrating control circuitry in the Service Module of FIG. 1.
Figure 13:
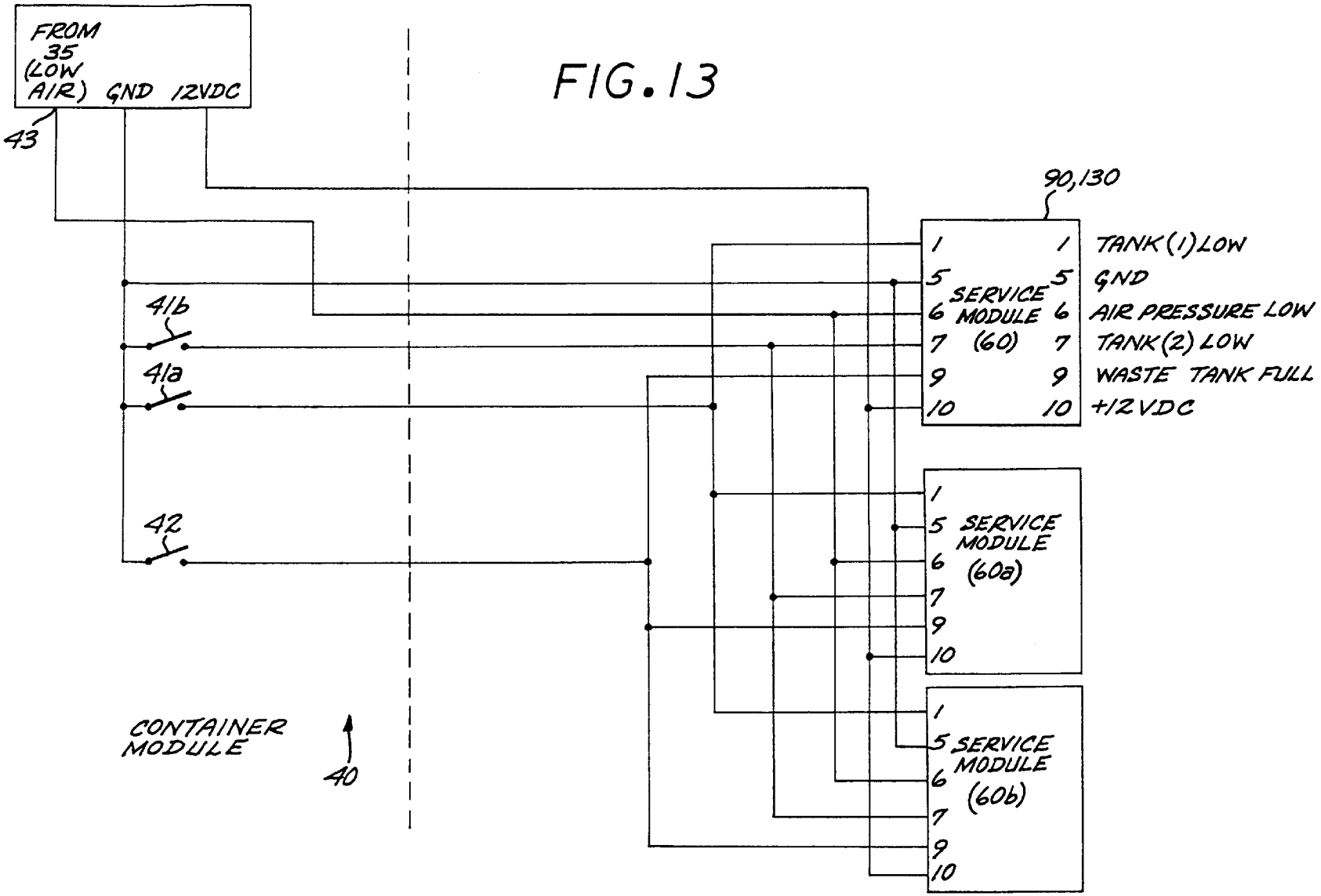
FIG. 13 is a wiring diagram illustrating status switches connected to the Container Module status terminals of FIG. 1.

Turning again to FIG. 1, the status switches providing signals to the CPU 130 are presented in the terminal board 40 layout that will be discussed in association with FIG. 13. The control circuitry 90 providing signal voltages to the above-described solenoid valves, the pump 76 and the CPU 130 input, and accepting other signals from the flow meter 78 and the CPU 130 output, is presented in FIG. 12. Finally, major functions of the CPU 130 are the subject of the descriptive diagrams of FIGS. 14 and 15.

With respect to FIG. 2, the functions of the various switches and indicators will become apparent when the operation is discussed in the Operation section below. Switches include Power 94, Mode 98, Oil Type 100, Start 102, Stop 104 and the keypad 112 including Enter button 114. Visual and audible indicators are buzzer speaker 93, display window 96, "Evacuate" LED 106, "Inject" LED 108 and "Complete" LED 110.

Operation and Fluid Flow

Complete operational sequence is diagrammed in the flow charts of FIGS. 3 through 11. FIG. 1 will be referenced when mechanical implementation of the charted sequences is discussed, and FIGS. 2 and 12–15 will assist in understanding the electrical implementation.

Figure 3:
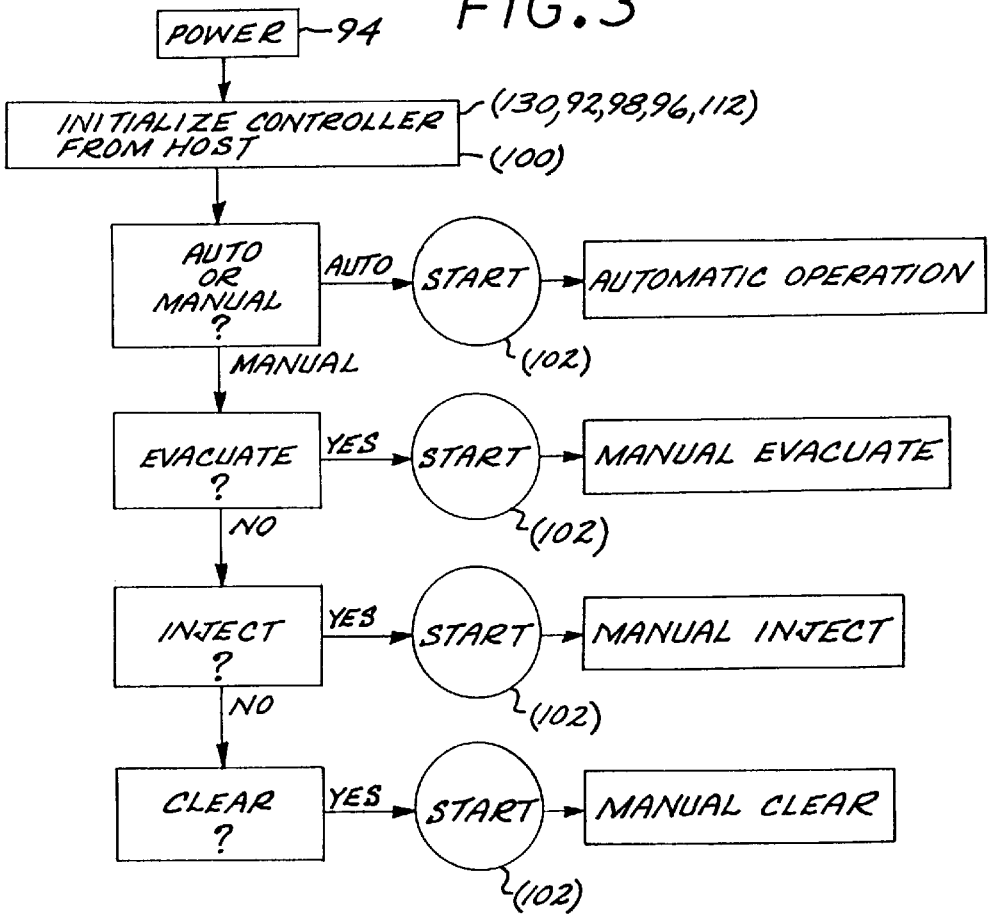
FIG. 3 is a block diagram illustrating a main overview of the manual and automatic selections available in the method of the present invention.

FIG. 3 illustrates a main flow chart from which the remaining operations proceed. An operator switches on the Power switch 94 on control panel 92 (FIG. 2) and initializes the CPU 130 by first pressing the Mode button 98 until prompted in the Display 96 to enter "oil to add quantity". Quantity in quarts (or liters) to the nearest tenth is entered via the keypad 112. When Display 96 prompts for oil type, Type button 100 is pressed to select between fresh oil tanks 24 and 26 (FIG. 1). When the oil quantity and type has been thus initialized, the display 96 shows "Ready to Start".

Figure 4:
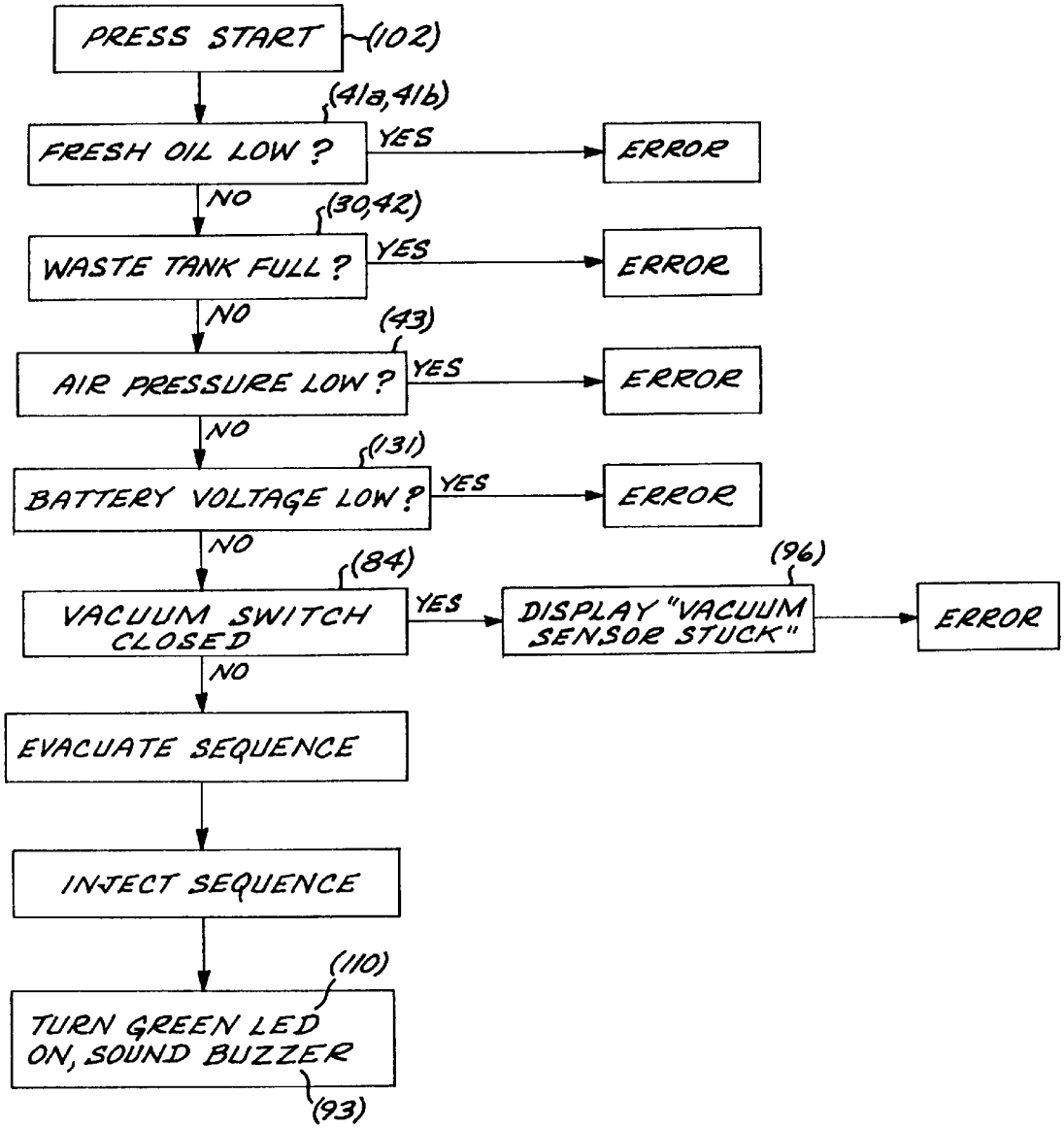
FIG. 4 is a block diagram illustrating the Automatic operation steps from the selections of FIG. 3.

For Automatic operation, if "Auto" is not already displayed in window 96, the operator presses the Mode button 98 until "Auto" is displayed, then presses Start button 102 to begin the Automatic Sequence to be described in connection with FIG. 4.

For Manual operation, the operator presses the Mode button 98 until "Manual" is displayed along with the particular one of three programs desired. For example, if manual evacuation of oil from an engine is desired, the Display 96 is made to show "Evacuate Oil", and the Start button 102 will begin the Manual Evacuate operation of FIG. 5; for manual injection of oil from one of the tanks 24,26, the Display 96 will show "Inject Oil" and button 102 begins the Manual Inject operation of FIG. 6; and for manual purging or clearing of the fluid lines, the Display 96 will show "Clear System", and the Start button 102 is pressed to begin the Manual Clear operation of FIG. 7. AUTOMATIC SEQUENCE When the operator has selected "Auto" and pressed the Start button 102, the sequence of FIG. 4 is carried out. The CPU 130 samples the signals from the terminals in the status circuit 40 (FIG. 1). First the selected fresh oil tank 24 or 26 is checked for low oil. If a low oil switch 41*a* or 41*b* (FIG. 13) is detected closed, the Display 96 shows "Low Fresh Oil" and the ERROR sequence of FIG. 11 is executed. If fresh oil is not low, the waste tank 28 is checked for being full. If a waste tank full switch 42 is closed, the Display 96 shows "Waste Tank Full" and the ERROR sequence is executed. If the waste tank 28 is not full, a pressure signal from an air compressor pressure sensor (not shown) to pressure terminal 43 (FIG. 13) is sampled, and if an air pressure below about 60 psi is detected, the Display 96 shows "Low Air Pressure" and the ERROR sequence of FIG. 11 is executed.

Figure 8:
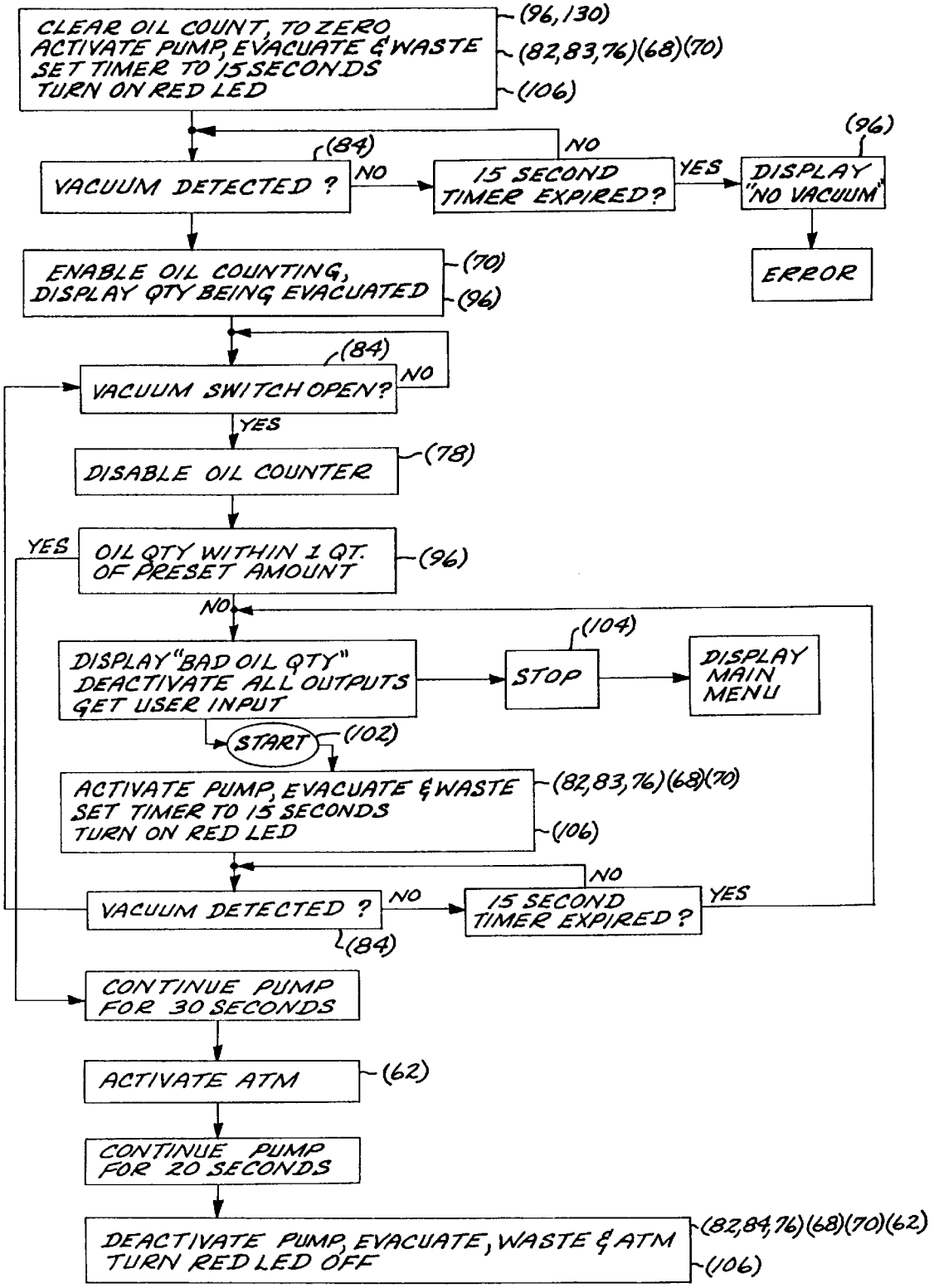
FIG. 8 is a block diagram illustrating the automatic EVACUATION Sequence steps from the Automatic operation of FIG. 4.
Figure 14:
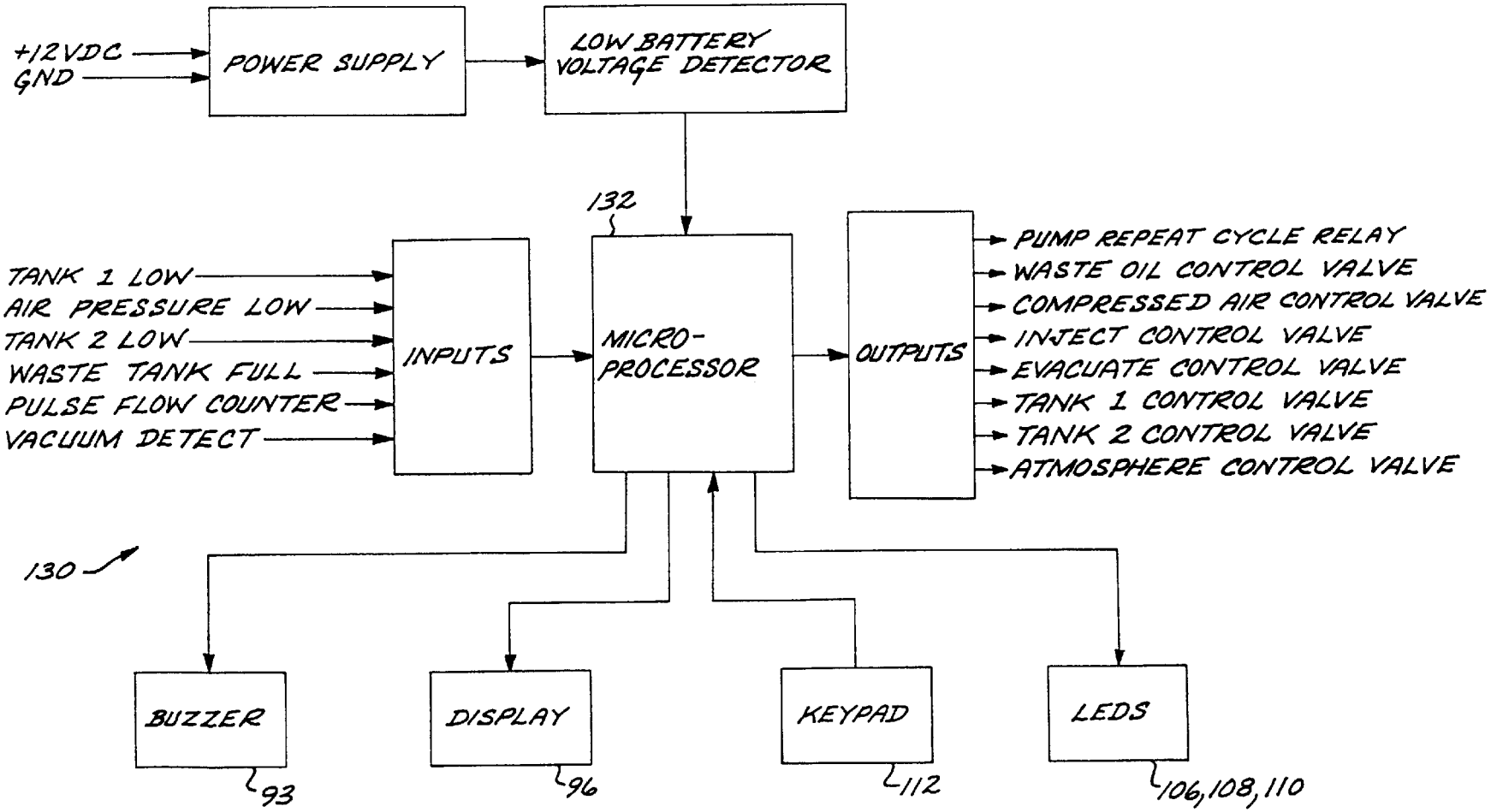
FIG. 14 is a functional block diagram illustrating major driver subcircuits of the Central Processing Unit of FIG. 1.

The check for power supply voltage level is performed by a Low Battery Voltage detector circuit 131 in the CPU 130 (FIG. 14). If a low voltage is detected, the Display 96 shows "Low Battery" and the ERROR sequence is executed. Next the vacuum switch 84 in the service module circuitry 90 of FIG. 12 is tested, and if detected open (i.e., no subatmospheric pneumatic pressure is present in manifold line 69), the EVACUATE sequence of FIG. 8 is executed to extract waste oil from the engine 152. If the vacuum switch 84 is closed (vacuum is present in manifold line 69), the evacuation control valve 68 is opened. If the vacuum disappears within 15 seconds, showing presence of fluid in the manifold 69, the evacuation control valve 68 is closed and the EVACUATE Sequence is executed. Otherwise, a "Vacuum Sensor Stuck" message is displayed on the display window 96 and the ERROR sequence of FIG. 11 is executed.

Figure 9:
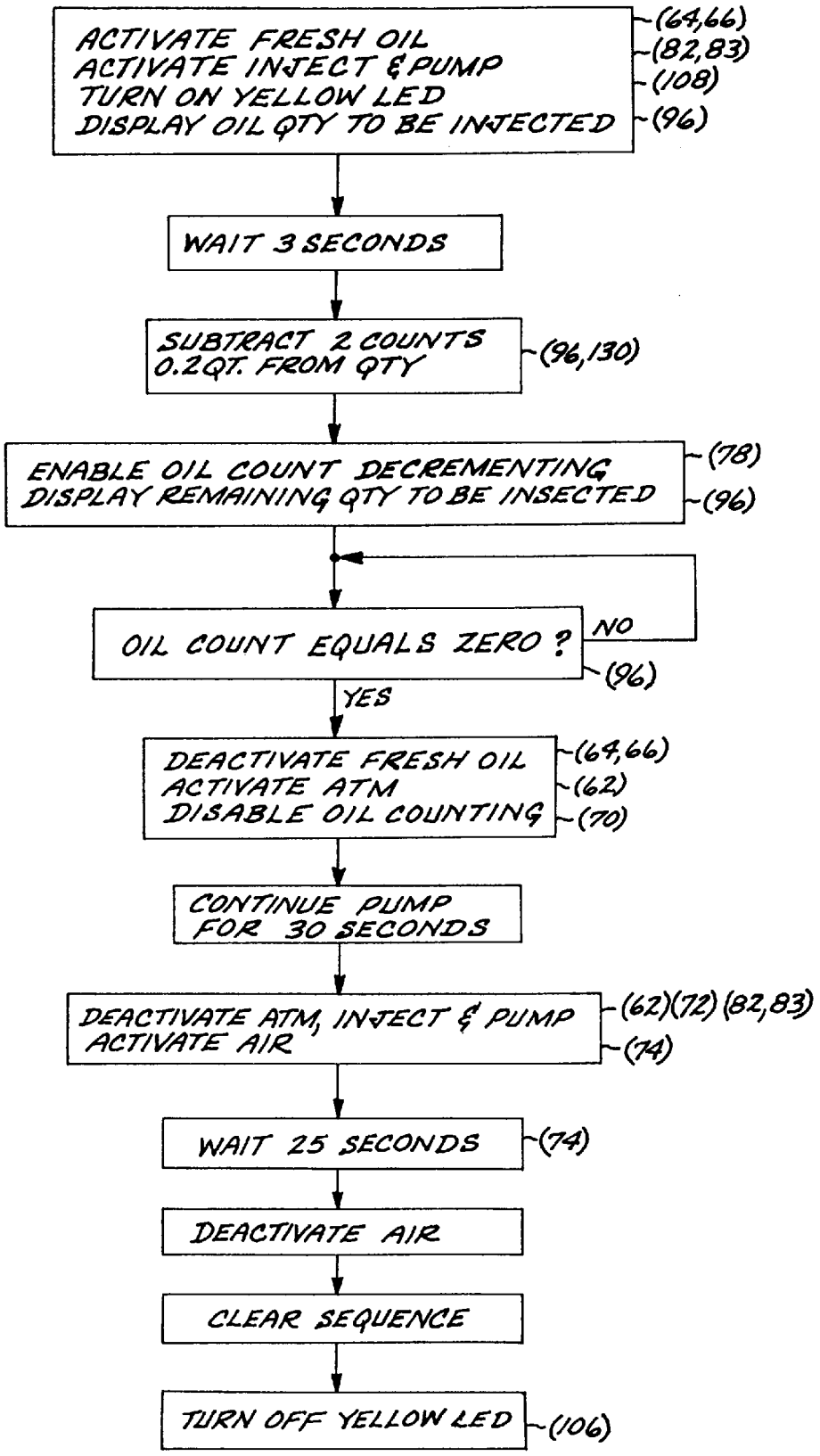
FIG. 9 is a block diagram illustrating the automatic INJECT Sequence steps from the Automatic operation of FIG. 4.

After the EVACUATE sequence is complete, the INJECT sequence of FIG. 9 is executed to deliver fresh oil to the engine 152. Once the INJECT sequence is complete, a green LED 110 is illuminated and a buzzer sounds from the speaker 93 for one second. The Display 96 shows "Done" , and the system pauses for the operator to press the Stop button 104.

MANUAL EVACUATE, INJECT AND CLEAR

Figure 5:
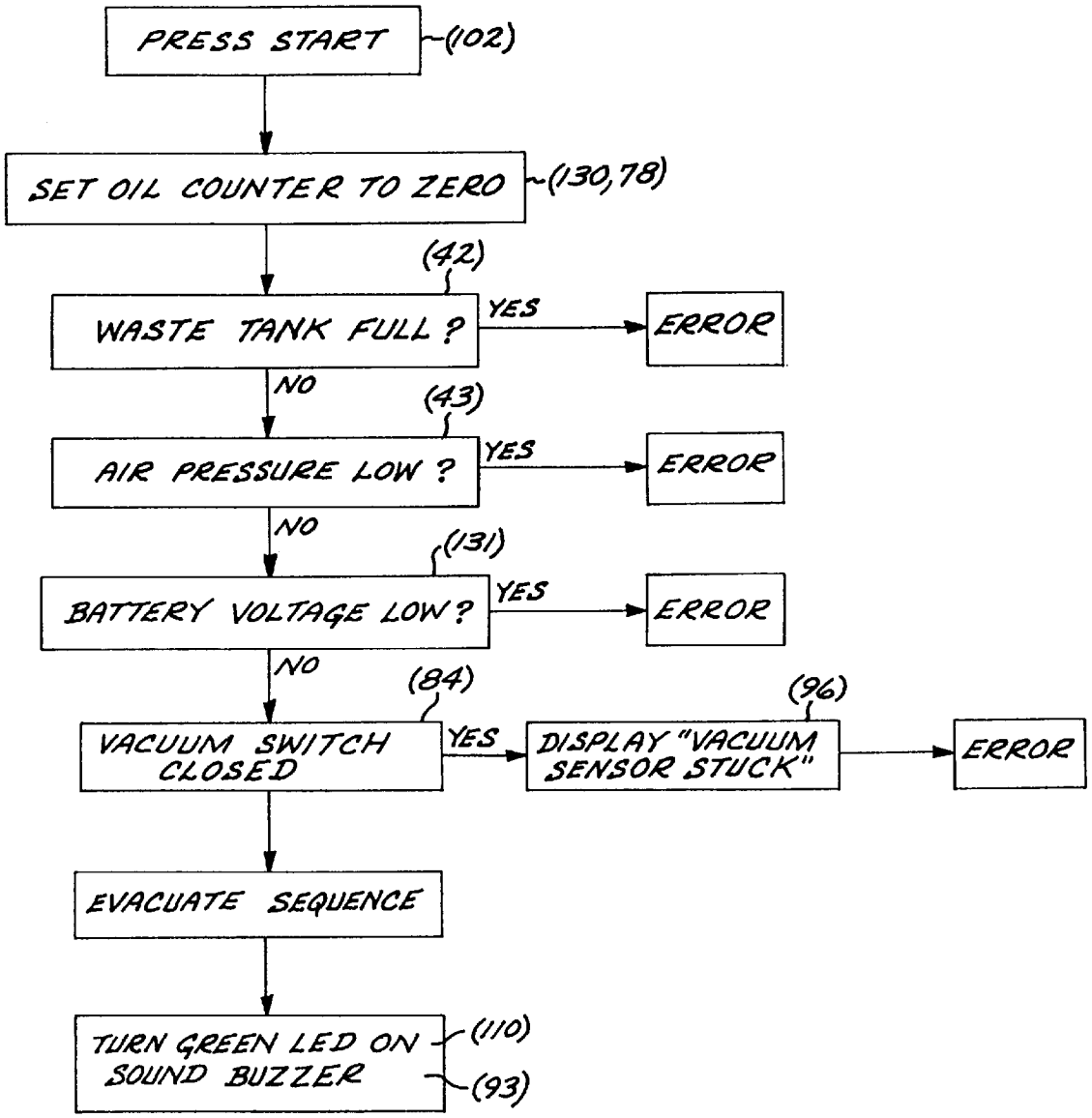
FIG. 5 is a block diagram illustrating the Manual-Evacuate operation steps from the selections of FIG. 3.

Referring now to FIG. 5, for manual evacuation of spent oil, when the operator presses the Start button 102, the CPU 130 resets the "oil add quantity" to zero, and the status checks for Waste Tank Full, Low Air Pressure, Low Battery Voltage, and Vacuum Sensor Stuck are made as described above. If the system passes all the status checks, the EVACUATE sequence of FIG. 8 is executed, the green LED 110, the buzzer speaker 93 and the Display 96 are activated, and the operator is prompted to press the Stop button 104.

Figure 6:
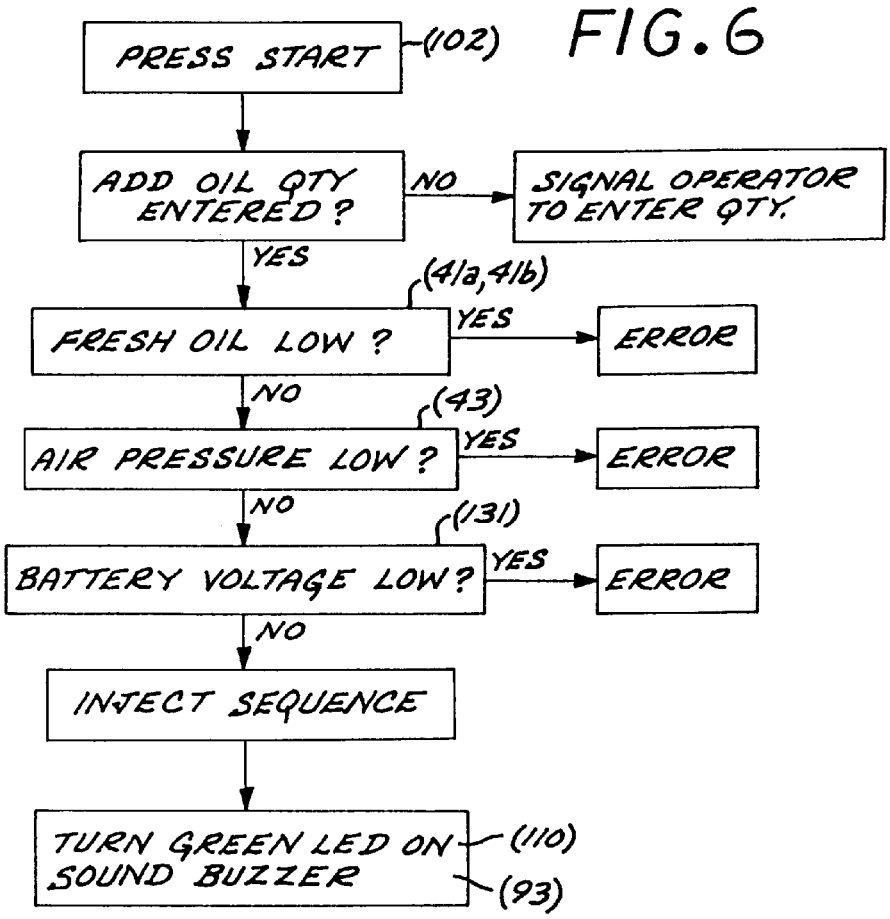
FIG. 6 is a block diagram illustrating the Manual-Inject operation steps from the selections of FIG. 3.

FIG. 6 shows a similar chart for manual injection of new oil. Here, "add oil quantity" is checked by the CPU 130 to make sure an amount has been entered. If not, the operator must enter an oil amount via the keypad 112 before the sequence will continue.

The status checks for Low Fresh Oil, Low Air Pressure, Vacuum Sensor Stuck, and Low Battery are made as discussed above, and if passed successfully, the INJECTION sequence of FIG. 9 is executed and the operator is signalled as previously noted to press the Stop button 104.

Figure 7:
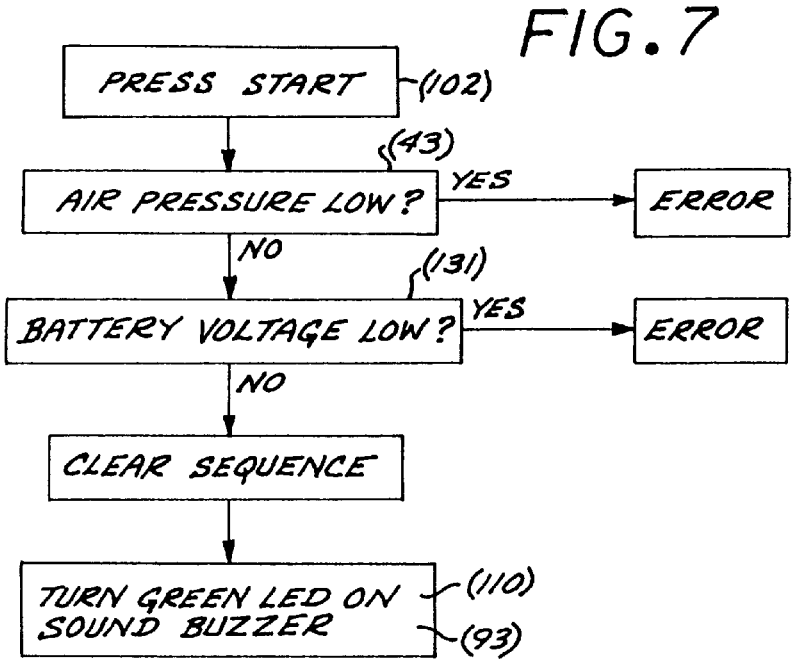
FIG. 7 is a block diagram illustrating the Manual-Clear operation steps from the selections of FIG. 3.

For the Manual Clear operation, refer to FIG. 7. After successful tests for air pressure and battery level, the CLEAR sequence of FIG. 10 is executed, and the completion indicators are activated as before.

The following subroutines are fully automated, with operator involvement required only in the event of a system error. Ready access to FIGS. 1,2 and 12 will be helpful to assimilate the mechanical and electrical implementation of the EVACUATE sequence steps as well as the steps of the INJECT, CLEAR and ERROR sequences to follow. The EVACUATION sequence is a subroutine of both Automatic Operation and Manual Evacuate Operation as described above. The INJECT sequence is a subroutine of both Automatic Operation and Manual Inject Operation. The CLEAR sequence is a subroutine of the Manual Clear Operation and INJECT sequence (and thus a sub-subroutine of Automatic Operation), and the ERROR sequence is a subroutine of all of the above except itself and the CLEAR sequence.

EVACUATION SEQUENCE

FIG. 8 illustrates the automated events controlling the valves and fluid flow in the service module 60 for EVACUATION. The oil count is cleared to zero by the CPU 130 on Display 96. The Evacuation valve 68 and the waste control valve 70 are opened to clear a fluid path from the reel hose 77 through the evacuation conduit 71, the pump 76 and the waste conduit 75 to the waste tank 28 (FIG. 1). The pump 76 is activated by signalling a repeat cycle relay 82 controlling the pump valve 83 to begin establishing subatmospheric pneumatic pressure (vacuum) in the last mentioned fluid path to draw spent oil via connector hose 160 or dipstick tubing 164 through reel hose 77. The red LED 106 is illuminated, signifying evacuation in progress. If after 15 seconds the vacuum switch 84 (FIG. 12) does not detect a vacuum in the manifold 69, the display window 96 displays a "No Vacuum Error" message, and the ERROR sequence of FIG. 11 is executed.

If vacuum is detected within the 15 second span, the flow meter 78 is enabled and the Display 96 shows the quantity of oil being evacuated. The flow meter 78 is not started until vacuum is detected, but will only generate an output signal when fluid, i.e., air or oil, is flowing in the pump 76. When fluid flow stops, the vacuum disappears and the flow meter 78 is disabled.

In a Quantity Comparison sub-sequence beginning with the "Vacuum Switch On?" test of FIG. 8, the system waits for the vacuum switch 84 to signal vacuum disappearance, then disables flow meter 78 and compares the displayed oil count with the preset "oil add quantity" in the CPU 130.

If the Display 96 count is less than one quart (or one liter for metric applications) below the preset amount, the system pauses for 30 seconds and then opens the atmospheric air valve 62 to admit unpressurized air to pump input manifold 69 for 20 seconds, during which time the manifold 69, the reel hose 77, the evacuation line 71 and the waste conduit 75 are cleared. All open valves (pump, evacuate valve, waste valve and atmosphere valve) are then closed, and the red LED 106 is turned off.

If, on the other hand, the gap between oil evacuated as counted on Display 96 and oil quantity as preset in CPU 130 exceeds one quart, a User Input sub-sequence is executed wherein all valves are closed, a "Bad Oil Quantity" message is displayed in window 96, the red LED 106 is extinguished, and the system halts for operator input. If the Stop button 104 is pressed, the system idles and the starting menu is shown in the Display window 96. If the Start button 102 is pressed, the pump valve 83, evacuation valve 68 and waste valve 70 are once more opened, the red LED is turned back on, and the Display 96 continues to show the quantity of oil evacuated so far.

If no vacuum is detected after 15 seconds, the sequence returns to the User Input sub-sequence including the "Bad Oil Quantity" message display described above.

If vacuum is present within the 15 seconds, the system attempts again to complete the evacuation sequence by returning to the Quantity Comparison sub-sequence previously described.

INJECTION SEQUENCE

FIG. 9 illustrates the automated events controlling the valves and fluid flow in the service module 60 for INJECTION. The "add oil quantity" count is provided by the CPU 130 to the Display 96. A selected one of the fresh oil valves 64, 66 and the injection valve 72 are opened to clear a fluid path from reel hose 77 through the injection conduit 73, the pump 76 and the manifold 69 from fresh oil tank 24 or 26 to the oil pan 154 via the connector hose 160 or the dipstick tubing 164 (FIG. 1). The pump 76 is activated by signalling the repeat cycle relay 82 controlling the pump valve 83 to begin creating a pressure to force fresh oil through the manifold 69, and the yellow LED 108 is illuminated signifying injection in progress. After 3 seconds, two counts (0.2 quarts, or 0.2 liters) are subtracted from the "add oil quantity", and the window 96 displays the remaining oil quantity to be injected.

The flow meter 78 is enabled and the Display 96 continues to monitor the quantity of oil being injected into the engine 152. When the quantity in the Display 96 reaches zero, the CPU 130 then disables the oil flow meter 78, closes the selected fresh oil valve 64 or 66, and opens the atmospheric air valve 62 to allow air to be pumped through the lines. After 30 seconds, the atmospheric air valve 62, the injection valve 72 and the pump valve 83 are closed, and the compressed air valve 74 is opened for 25 seconds, during which time the reel hose 77 and the selected connector line 160 or 164, whichever is used, is cleared. The compressed air valve 74 is then closed, the CLEAR Sequence is executed, and the yellow LED 108 is turned off.

CLEAR SEQUENCE

Referring to FIG. 10, the CPU 130 executes the CLEAR sequence to flush the system lines of oil after the various operations in the following manner. The atmospheric air valve 62, the injection valve 72 and the pump valve 83 are opened, and the pump 76 is allowed to run for 20 seconds, after which all three valves are closed. The compressed air valve 74 is then opened for 30 seconds and then closed, the reel hose 77 and the connector line 160 or 164 having been cleared.

ERROR SEQUENCE

Audible and visible alarms to alert an operator to a condition that requires operator input are described in the flow chart of FIG. 11. All valves are deactivated. The LEDs 106,108,110 are illuminated and the buzzer sounds from the speaker 93, all for one second out of every one and one-half seconds until an operator presses the Stop button 104.

DETAILED DESCRIPTION OF A SECOND EXEMPLARY EMBODIMENT

STRUCTURAL ARRANGEMENT

Figure 16:
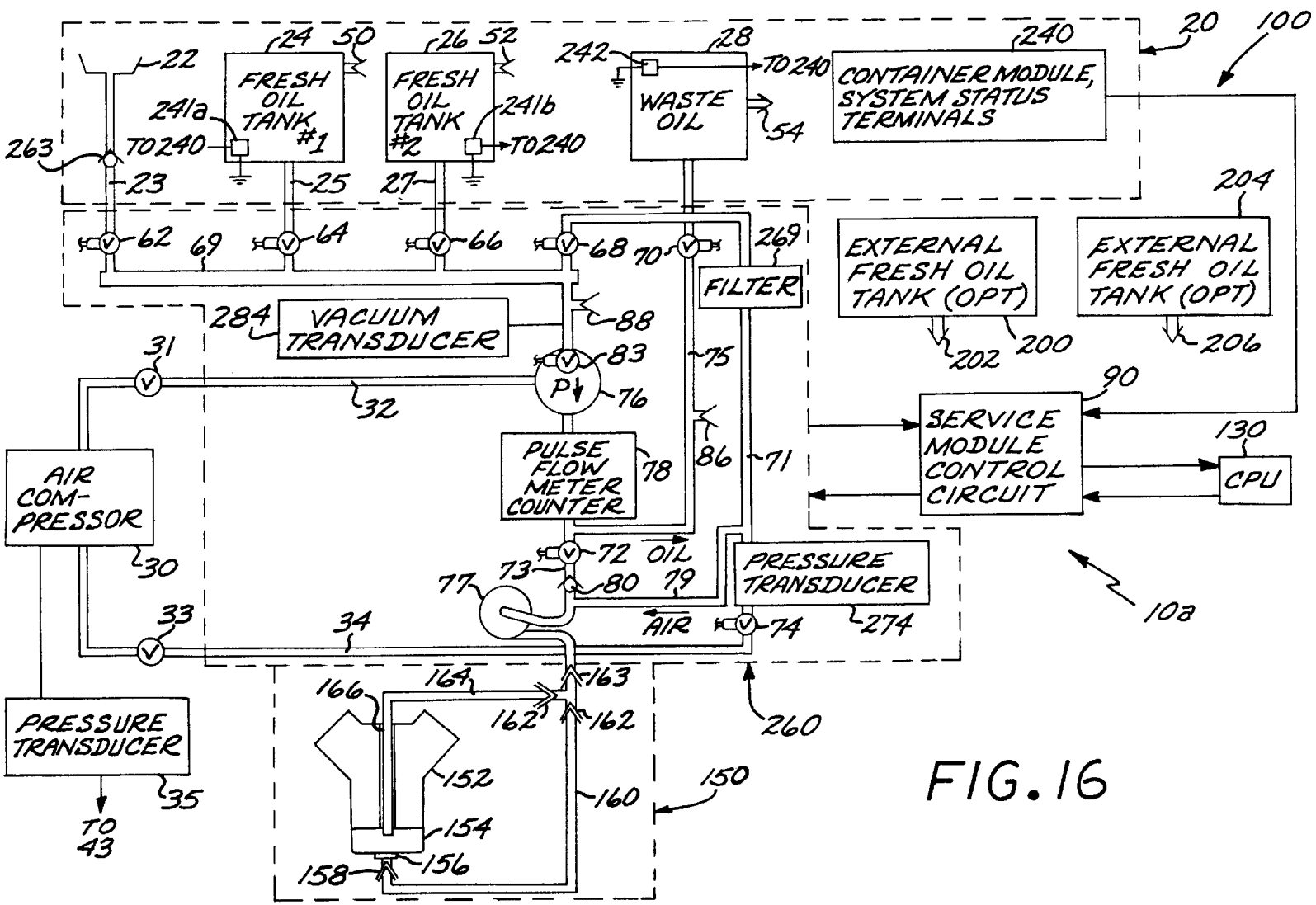
FIG. 16 is a pictorial diagram of a second embodiment of the computer controlled lubricating oil extraction and injection apparatus illustrating fluid flow and control features of the present invention.

An overview of a second embodiment of the present invention is presented in FIG. 16, wherein a computer controlled apparatus 10*a* for changing oil is illustrated. The second embodiment illustrated in FIG. 16 provides additional feedback information to a service module control unit 90*a* and a system central processing unit 130*a*.

The physical configuration of the second embodiment of the apparatus 10*a* is similar to the embodiment described above in connection with FIG. 1. Therefore, many features and elements shared between the embodiment shown in FIG. 16 and the embodiment shown in FIG. 1 will not be described here.

The system shown in FIG. 16 removes fluid such as lubricating fluid or oil from a fluid receptacle such as the crankcase 154 of an internal combustion engine 152 contained within a vehicle 150, and injects a fresh fluid into the receptacle 154. A specific quantity of fresh fluid is to be injected into the crankcase fluid receptacle 154, which amount depends on the engine 152.

In the service module 260, a filter 269 in the evacuation conduit 71 filters debris from the oil evacuated from the vehicle engine, thereby minimizing clogging of the evacuation control valve 68, the pulse flow meter 78, and the waste flow control valve 70, and reducing the probability of damage to the pump 76. The filter 269 may be a 40 micron strainer of a type commonly available in the fluid management arts.

A first pressure transducer 274 is also connected to the evacuation conduit 71 to measure the pressure in the conduit 71. The first pressure transducer 274 produces an electric signal to the service module control unit 90*a* indicative of a pressure in the conduit 71. This pressure signal may be used as a feedback signal during the steps of directing compressed air through the line 71 to clear oil from the line 71, as in the Clear System sequence shown in FIG. 33 and described below. Pressure transducers suitable for the apparatus 10*a* are widely available and well understood in the art. One suitable transducer is model MPX5500, manufactured by Motorola.

A second pressure transducer, termed a "vacuum transducer" 284, replaces the vacuum switch 84 of the apparatus shown in FIG. 1. The vacuum transducer 284 provides a range of pressure readings to the service module control unit 90*a* concerning the subatmospheric pressure ("vacuum") in the manifold conduit 69, instead of the a simple binary (on/off) function provided by the pressure switch 84 of the FIG. 1 embodiment as described above. A Motorola MPX5100 transducer mav be used.

The functions performed by the repeat cycle relay 82 in the first embodiment shown in FIG. 1 are programmed into the CPU 130*a*, which is described below in connection with a second embodiment of the operation and fluid flow processes.

A check valve 263 is placed on the atmospheric conduit 23. The check valve 263 minimizes or prevents leakage of oil to the atmosphere when the valve 62 is under pressure from the manifold conduit 69.

The first fresh oil tank 24, the second fresh oil tank 26, and the waste oil tank 28 contain pressure transducers 241*a*, 241*b*, 242, respectively. The pressure transducers 241*a*, 241*b*, 242 provide to the container module system status terminals 240 electrical signals indicative of the pressures in the tanks 24, 26, 28, respectively. Those pressures are proportional to the quantities of oil in each of those tanks. Thus, the signals from the pressure transducers 241*a*, 241*b*, 242 are indicative of the quantities of oil in the tanks 24, 26, 28, respectively. An appropriate fluid pressure transducer is manufactured by Motorola and sold as model number MPX5010.

Additional fresh oil tanks for different types of fluid may be included in the system. Such additional tanks are represented in FIG. 16 by the optional third and fourth fresh oil tanks 200, 204. Each such additional tank includes a fluid pressure transducer for measuring the quantity of fluid in that tank. Those additional fluid pressure transducers are similar to the transducers 241*a*, 241*b*, 242 used in the tanks 24, 26, 28.

Each additional fresh oil tank 200, 204 includes an outlet conduit 202, 206, respectively. Each such outlet conduit is controlled by an electrically operated valve (not shown) that is similar to the valves 64, 66 on the first and second fresh oil tanks 24, 26.

Those skilled in the art will recognize that it may be beneficial to include an access port on the waste oil conduit 75 adjacent the waste oil tank 28. Such an access port allows the operator to take a sample the waste oil evacuated from a vehicle or engine for analysis.

Flange fittings (not shown) may be included on the pump 76 at the pump inlet to simplify the physical removal of the pump 76 from the system.

The schematic and wiring diagram of FIG. 12 is also applicable to the second embodiment, except for some minor differences. The vacuum switch 84 shown in FIG. 12 is replaced with a vacuum transducer 284 (FIG. 16), and the output to the container module is replaced with an output to a modified container module 240, as described below in connection with FIG. 19.

Figure 19:
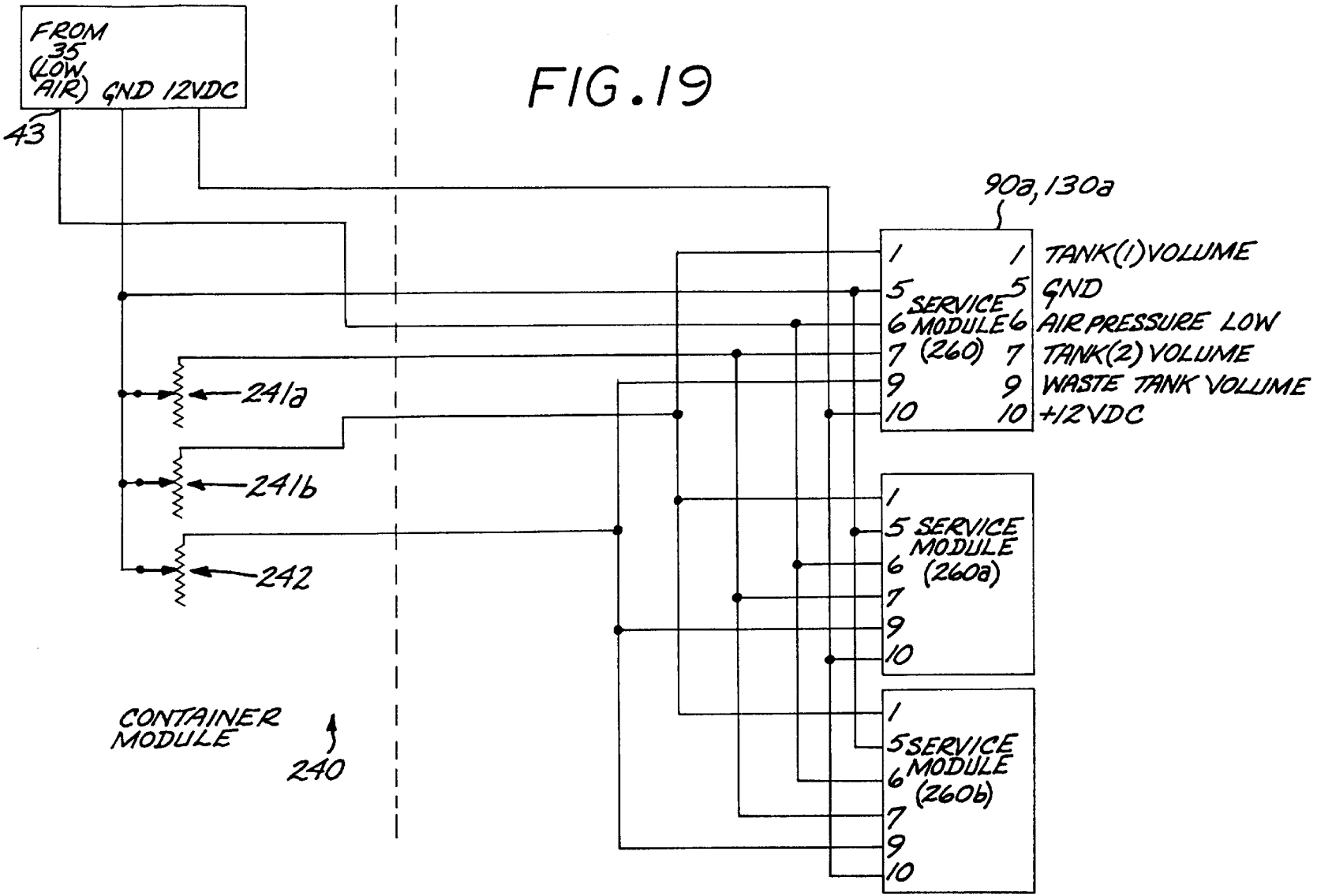
FIG. 19 is a wiring diagram illustrating status switches connected to the Container Module status terminals of the system of FIG. 16.

The status transducers providing signals to the service control circuitry 90*a* are illustrated in the terminal strip 240 layout that is presented in more detail in FIG. 19. The diagram of FIG. 19 is comparable to the diagram of FIG. 13 for the first embodiment. Ground, +12 volt DC power, and an air pressure input signal, are brought into the container module terminal strip 240, and distributed as shown in FIG. 19 as outputs to the service module control circuits 90*a* and the CPU 130*a*. Although three modules 260, 260*a*, 260*b* are shown, it will be apparent that any number of modules 260 may be included in a system, including one or more than one.

DETAILED DESCRIPTION OF A THIRD EXEMPLARY EMBODIMENT

STRUCTURAL ARRANGEMENT

Figure 17:
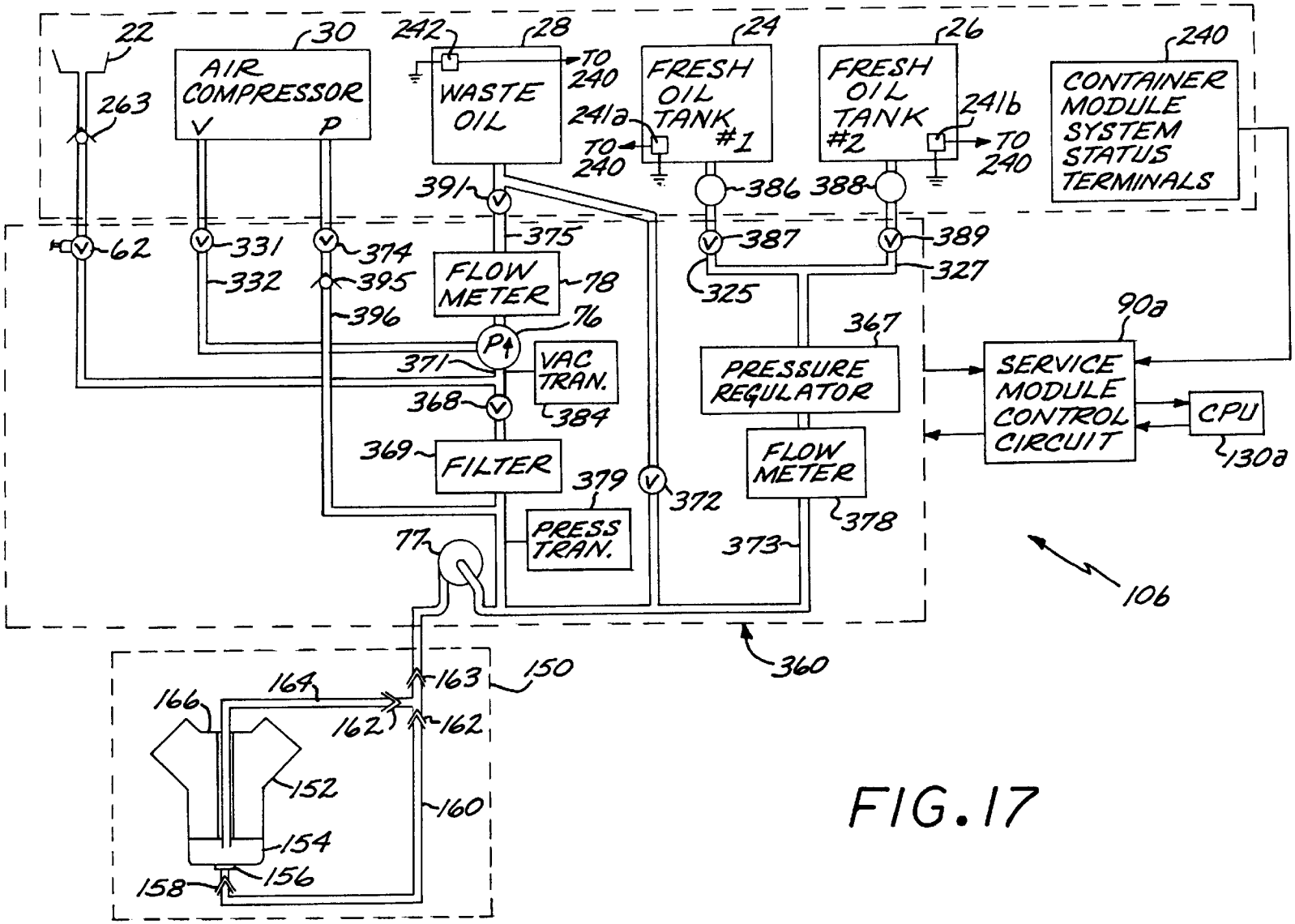
FIG. 17 is a pictorial diagram of a third embodiment of the computer controlled lubricating oil extraction and injection apparatus illustrating fluid flow and control features of the present invention.

Shown in FIG. 17 is a system overview of an apparatus 10*b* in accordance with a third exemplary embodiment all of the present invention. The exemplary embodiment shown in FIG. 17 is particularly useful in installations in which fresh oil delivery systems are already in place. For example, many service facilities have high-pressure oil delivery systems already in place to deliver fresh oil from fresh oil tanks such as the fresh oil tanks 24, 26 to the service bay at which a vehicle containing the engine 152 may be located. The service module 360 of FIG. 17 accommodates such existing fresh oil delivery systems.

A typical high pressure oil delivery system that is installed in a service facility includes one or more fresh oil tanks 24, 26. Each tank 24, 26 has a high pressure pump 386, 388 for selectively delivering oil to the conduits 325, 327, respectively, at high pressure. In certain embodiments, electrically controllable valves 387, 389 may be included in the fluid conduits 325, 327 within the module 360 to control the outflow from those fresh oil tanks 24, 26, respectively. The fluid conduits 325, 327 combine into a single fresh oil conduit 373.

A pressure regulator 367 in the fresh oil conduit 373 reduces the pressure of the fresh oil in the conduit 373. The pumps 386, 388 in oil delivery systems commonly installed in automotive service facilities supply fresh oil at pressures of up to approximately 1,000 pounds per square inch. The pressure regulator 367 reduces that pressure to approximately 100 pounds per square inch. A second flow meter 378 downstream from the pressure regulator 367 measures the quantity of fresh oil flowing through the fresh oil conduit 373.

The computer control of the system, preferably including the control as described below, controls the electrically controlled valves 387, 389 to control the delivery of fresh oil to the fresh oil delivery conduit 373. This control is substantially the same as the control of the valves 64, 66 in the embodiments shown in FIGS. 1 and 16. In certain implementations in which the service module 360 is integrated with the oil delivery system installed in the service facility, the control circuit 90*a* may be connected to the pumps 386, 388 to activate and deactivate those high pressure pumps 386, 388 as a means of controlling the delivery of fresh oil to the fresh oil delivery conduit 373.

A pressure relief valve 372 on the conduit 373 relieves excess pressure that may build up in the conduit if there is an obstruction in the conduit downstream of the pressure relief valve 372. For example, if the oil delivery hose becomes blocked or kinked, the pressure relief valve 372 relieves the pressure by directing the excess oil to the waste tank 28.

Because the installed fresh oil delivery system includes the high-pressure pumps 386, 388 to deliver the fresh oil, the pump 76 need only pump the waste oil from the engine 152. Similarly, the flow meter 78 measures only the waste oil directed from the engine to the waste oil tank 28. The second flow meter 378 measures the volume of delivered fresh oil.

The pump 76 is driven by compressed air from the air compressor 30. The air from the compressor 30 is regulated by the regulator valve 331 on the air conduit 332. The pump 76 draws sub-atmospheric pressure on the conduit 373, evacuating oil from the engine 152 through the hose on the hose reel 77.

The evacuated oil is filtered by a filter 369. Again, the filter 369 may be a 40 micron screen. An evacuation control valve 368 may be opened or closed to govern whether the pump 76 draws sub-atmospheric pressure to that conduit.

A vacuum transducer 384 measures the sub-atmospheric pressure in the conduit 371. A pressure transducer 379 measures the pressure in the evacuated oil conduit 371.

Pressurized air is applied to the conduit 371 by the air compressor 30 through an air conduit 396. The flow of compressed air is controlled by the regulator valve 374. A check valve 375 is also included in the air conduit 396.

An atmospheric outlet 22 is provided to the conduit 371 in the same manner as the atmospheric outlet in the embodiments shown in FIGS. 1 and 16.

A waste oil tank inlet valve 391 may be included on the waste oil conduit 375 to limit the ability of oil from the waste oil tank 28 from re-entering the conduit 375.

As with the other embodiments, the service module control circuit 90*a* controls the valves 387, 389 on the high-pressure delivery conduits 325, 327, the air pressure valves 331, 374, the atmospheric vent valve 62, the evacuation control valve 368, and the waste oil tank inlet valve 391. The service module control circuit 90*a* receives fluid flow readings from the first and second flow meters 78, 378, pressure readings from the fluid pressure transducers 241*a*, 241*b*, 242, the vacuum transducer 384, and the pressure transducer 379. The service module control circuit 90*a* may be programmed so that if the relief valve 372 is activated, indicating that the pressure in the fresh oil conduit 373 is too high, the service module control circuit 90*a* causes the fresh oil valves 387, 389 to close to stop the delivery of high-pressure fresh oil to the conduit 373. This may be done because the opening of the relief valve indicates a problem in the oil delivery system.

DETAILED DESCRIPTION OF A SECOND EXEMPLARY EMBODIMENT OF THE OPERATION AND FLUID FLOW PROCESSES

A second embodiment of the operation and fluid flow processes of the present invention provides a menu-driven, computer automated system or apparatus and method for automatically extracting lubricating fluids from and injecting such fluids into an internal combustion engine. The operation and fluid flow processes are controlled by a service module control circuit 90*a*, which is connected to a CPU 130*a*.

The apparatus maintains an internal database that includes operator identification information. That operator identification information may be used to restrict access to some or all of the system to authorized persons, and to track the service operations performed by each operator. The database additionally includes data on vehicles or engines upon which services are performed. The vehicle database information permits the system to automatically determine the oil type, quantity, and other information when the vehicle or engine identification information is input to the system.

The apparatus described can perform a completely automatic service operation under computer control. Alternatively, by selecting appropriate menu options, the apparatus can perform many manual service functions. Thus, flexibility is provided through a high degree of interactivity between the system and the operator.

The apparatus measures the evacuated fluid quantities and the injected fluid quantities, and stores this information along with the vehicle identification information and operator identification in its database. That stored information may be later retrieved, and displayed or printed in a report. The apparatus also continuously monitors any operation in progress for problems. The apparatus may abort the operation and/or notify the operator if an error occurs.

The second embodiment of the operation and fluid flow processes of the present invention may be used with any of the exemplary system arrangements shown in FIGS. 1, 16, or 17.

A complete operational sequence of this second embodiment of the operation and fluid flow processes is diagrammed in the flow charts of FIGS. 20 through 37. The system apparatus configuration shown in FIG. 16 will be referenced when mechanical implementations of the charted sequences are discussed.

Figure 18:
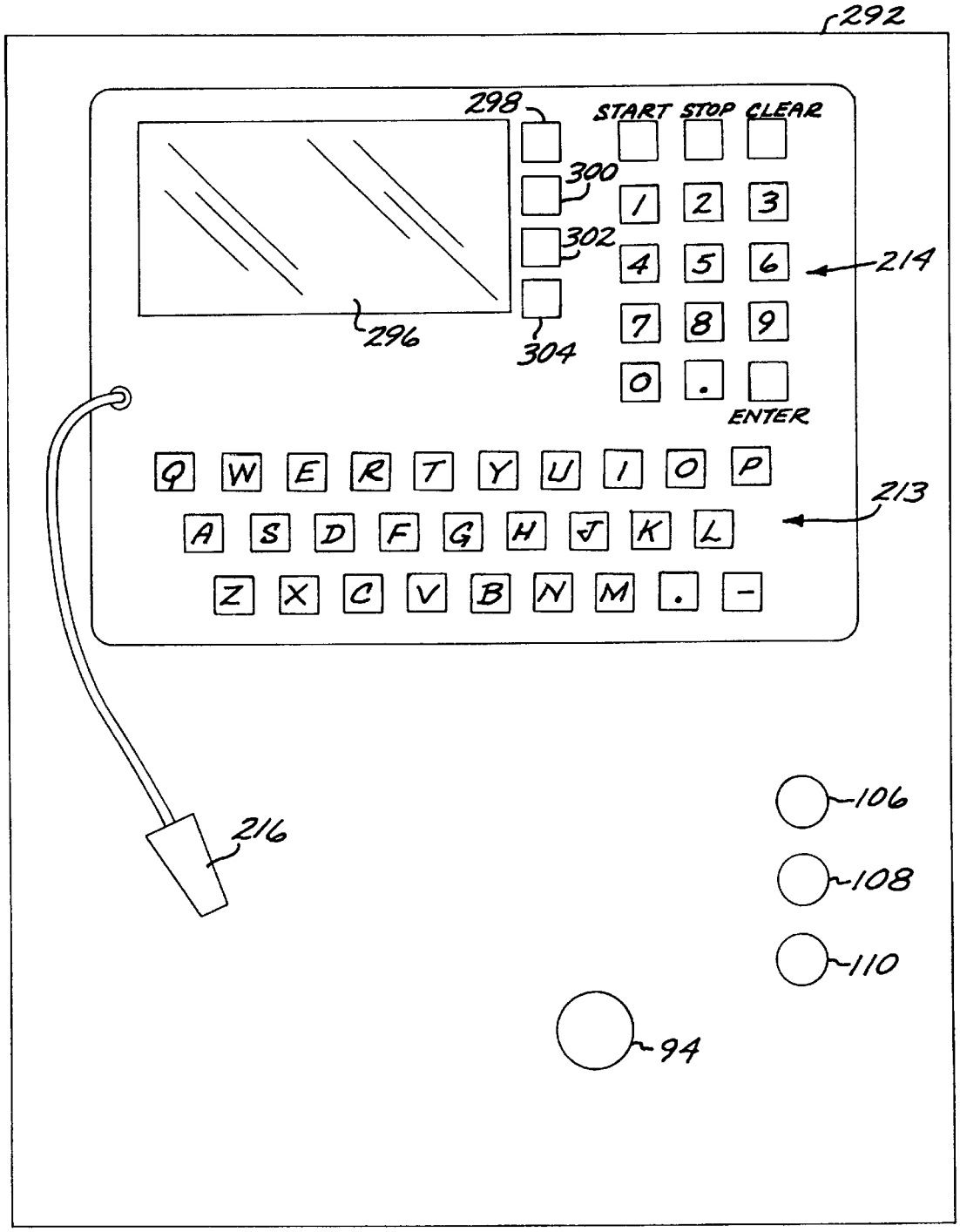
FIG. 18 is a front elevation view of a control panel of a second embodiment of a control panel for the oil extraction and injection apparatus incorporating the present invention, illustrating a functional layout of switches and indicators.

The second embodiment of the operational sequence of the present invention may be implemented using a second embodiment of the control panel 292, shown in FIG. 18. The control panel 292 includes a power switch 94, and red, yellow, and green LED's 106, 108, 110, respectively that are identical in form and function as the corresponding elements of the control panel 92 shown in FIG. 2. A buzzer speaker such as the buzzer speaker shown in FIG. 2 may be included, or an audible warning device (not shown) may be included elsewhere in the system.

The control panel 292 includes a keypad 213 for inserting alphabetic information, and a numeric keypad 214 for inserting numeric information. The control panel also includes special function keys START, STOP, CLEAR, and ENTER. A bar code reader 216 may also be connected to the system for reading bar code data into the system. The bar code reader 216 may be attached to the control panel 292, or may be attached to a different part of the system enclosure. The control panel 292 includes a display screen 296. The screen may advantageously be constructed of liquid crystal elements, forming a liquid crystal display. Those skilled in the art will recognize that numerous other types of displays may also be used.

Adjacent the screen 296 are selection switches or buttons 298, 300, 302, 304. As will be seen below, the system causes options to be displayed on the screen 296 adjacent the selection switches. A particular option may be selected by depressing the corresponding selection switch that is adjacent the option. The selection switches 298, 300, 302, 304 will change function depending on the options the operator selects, in accordance with the menus described below and in the accompanying flow charts.

The major functions of the CPU 130*a* are illustrated in the descriptive block diagram of FIG. 38. The elements of the descriptive block diagram of FIG. 38 are similar to those shown in the embodiment of FIG. 14. However, in the embodiment shown in FIGS. 16 and 38, analog signals are provided from the oil pressure transducers 241*a*, 241*b*, 242, the air pressure transducer 274, and the vacuum transducer 284. These analog signals are converted into digital signals for the microprocessor 132*a* by analog to digital converters 291. The Tank 1 Volume and Tank 2 Volume signals are provided by the oil pressure transducers 141*a*, 141*b*, respectively. Tank 3 Volume and Tank 4 Volume are provided by similar transducers in the additional fresh oil tanks such as the tanks 200, 204. The Waste Tank Volume signal is provided by the oil pressure transducer 242 in the waste oil tank 28.

The digital output from the pulse flow meter counter 78 is applied directly to one or more digital inputs 293. Input/output ports (I/O ports) 295 provide the ability for the microprocessor 132*a* to communicate with external peripheral equipment. The I/O ports 295 may include serial and parallel ports consistent with standard computer ports. In addition, a conventional floppy disk controller 297 provides removable data storage capability. Memory 305 provides storage for operator and vehicle database information. The memory 305 may include random access memory (RAM) with at least 128K capacity, and 128K or 256K of in-circuit programmable read only memory (PROM). All CPU output lines are monitored by connecting them back to the microprocessor inputs.

References to entering information on the control panel will refer to the second embodiment of the control panel 292 shown in FIG. 18. References to electrical connections and implementations will be to FIGS. 12, 19, and 38.

Many of the operations performed are identical or very similar to those performed in the first embodiment of the operation and fluid flow processes described above, including the control of the valves, and the operation of timers. Therefore, these will not be described in detail here, and those skilled in the art will understand their operation by reference to the description above.

For many installations in fixed locations, the power supply may be 110 volt AC power. In the first embodiment described, the power supply is described as a battery. However, those skilled in the art will recognize that the power supply may include an AC to DC converter for converting the 110 volt AC power to DC power for easy use by the components of the system.

INITIAL STEPS

Figures 20, 21, 22:
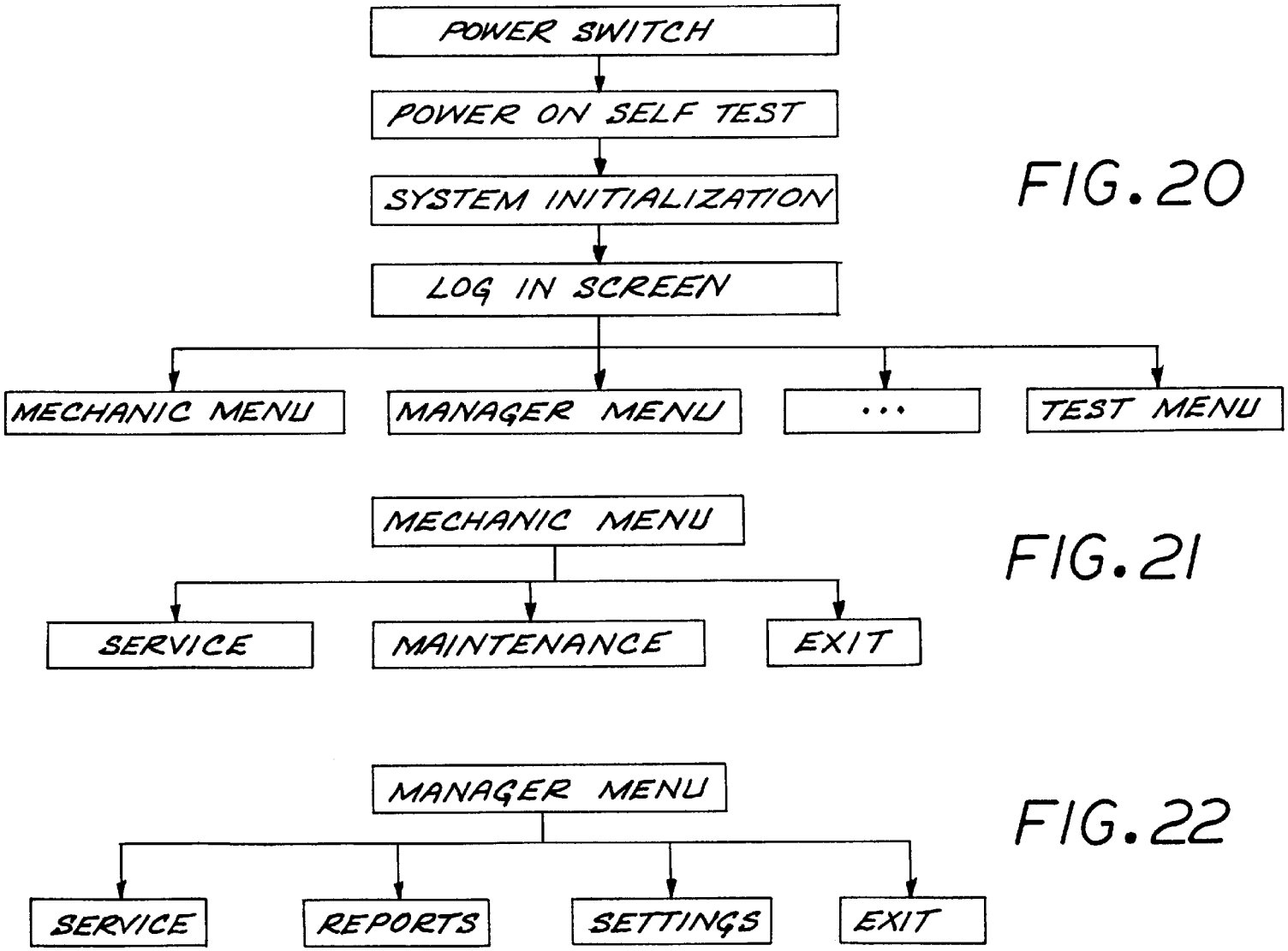
FIG. 20 is a block diagram illustrating an initial portion of a second embodiment of the method of operation of the present invention.
FIG. 21 is a block diagram of the beginning steps of the Mechanic section of the method of the present invention.
FIG. 22 is a block diagram of the beginning steps of the Manager segment of the method of the present invention.

FIG. 20 illustrates a main flow chart from which the remaining operations proceed.

The operator switches on the power switch 94 (FIG. 18) on the main system control panel 292. The programmed microprocessor 132*a* (FIG. 38) causes the system to perform its power on self test (POST) sequence. The POST sequence checks that all system components are operating properly.

The microprocessor 132*a* then causes all of the system control systems to be initialized. The system memory 305 is initialized, and the system databases are prepared for access.

The microprocessor 132*a* than causes the screen 296 to display a "log-in" screen. The log-in screen prompts the operator to enter specified operator identification information. The operator identification information may be alphanumeric information entered on the control panel 292 using one or both of the keypads 213, 214. Alternatively, the operator identification information may be entered through the bar code reader 216 by scanning the operator's badge or other identification device. Preferably, the microprocessor 132*a* is programmed so that no further sequences can be performed until a valid operator identification is entered. Valid operator identifications are stored in the system database, which is stored on the system memory 305.

The database of operator identifications may be constructed by adding information relevant to the use of the system. For example, system operators may add the identification information for the operators who will use a particular system. This information may be entered into the database as it is stored on the system memory 305. For example, when the system is used in a maintenance garage for a fleet of vehicles, identification information for each of the mechanics and technicians who are expected or permitted to operate the system may be entered into the database. Operator identifications may also be removed from the stored database as necessary. For example, if a mechanic leaves the fleet garage, that mechanic's operator identification information may be removed from the operator database.

Once a valid operator identification has been entered, the microprocessor 132*a* causes the screen 296 to display a number of options. Each option is displayed adjacent a corresponding one of the mode or selection switches 298, 300, 302, 304. This set of options is the main menu for the system.

In the illustrated embodiment, three options are available at the main menu, as shown in FIG. 20: Mechanic Menu, Manager Menu, and Test Menu. The Test Menu may also be identified as the Diagnostic Menu. Additional selections may be provided by including different numbers of selection switches such as the selection switches 298, 300, 302, 304. These additional menu selections may be programmed by the manufacturer, or may be user defined. For example, certain diagnostic menus may be made available to the user at the main menu.

The selection Mechanic Menu is displayed next to the first selection switch 298. The selection Manager Menu is displayed next to the second selection switch 300. The selection Test Menu or Diagnostic Menu is displayed next to the fourth selection switch 304. If an additional operator option is desired, that option may be displayed next to the third selection switch 302.

In the embodiment described herein, the Mechanic Menu permits the operator to instruct the system to perform basic vehicle or engine service operations. The Manager Menu permits the operator to make certain changes to some options available within the system, and to prepare reports related to system usage. The Test Menu or Diagnostic Menu permits the operator to test and troubleshoot portions of the system.

Preferably, each operator identification is associated with an access level. The access level determines which functions within the system the operator is allowed to perform. For example, certain operator identifications may be limited to selecting the Mechanic Menu. Certain additional operator identifications may be permitted to select either the Mechanic Menu or the Manager Menu. Finally, a limited number of operator identifications may be permitted access to the Test Menu or Diagnostic Menu. This information is stored in the system database on the memory 305.

The system may be programmed so that it does not display options to which the particular operator does not have access. Thus, an operator whose identification provides access only to the Mechanic Menu may not see the Manager Menu or Diagnostic Menu options displayed on the display screen 296. In addition, the system may be programmed to display automatically from the operator identification information the level of the operator's access, and immediately display the Mechanic Menu, the Manager Menu, or the Test Menu as soon as the operator inputs the operator's identification information, without displaying the "main menu" described above.

Those skilled in the art will recognize that additional levels of security may be programmed into the microprocessor 132*a*. In addition, those reading the following description will recognize that different security levels may be placed at different points in the procedure selection processes described below. It will also be recognized that the database of operator identification information may be updated periodically to reflect changes in the security levels to which specific operators are assigned.

MAIN MENU SELECTIONS

If the Mechanic Menu is selected by depressing the first selection switch 298 while the main menu is displayed, or if the system automatically proceeds to the Mechanic Menu on the basis of the operator's identification information, additional options are presented on the screen 296 adjacent the selection switches 298, 300, 302. The selections may include Service (indicating "service vehicle"). Maintenance, and Exit, as illustrated in the flow diagram of FIG. 21. For example, the Service option may be displayed next to the first selection switch 298. The Maintenance option may be displayed next to the second selection switch 300. The Exit option may be displayed next to the third selection switch 302. If a particular implementation is to include a fourth option, it may be displayed next to the fourth selection switch 304. Additional selections may be provided to the operator by including different numbers of selection switches similar to the selection switches 298, 300, 302, 304.

The Maintenance option allows the operator to perform system maintenance operations (not shown).

The Exit option returns the system to the main menu. Most menus include an Exit option that returns the system to the next higher menu, to allow the operator to back out of a procedure.

The Manager Menu allows system management personnel access to information pertaining to the system, and the ability to change certain system parameters. If at the main menu, the Manager Menu option is selected by the pressing the second selection switch 300 adjacent the Manager Menu option while the main menu is displayed on the screen 296 (or the system automatically displays the Manager Menu on the basis of the operator's identification information), additional options may be displayed adjacent the selection switches 298, 300, 302, 304. For example, the selections may include Service, Reports, Settings, and Exit, as shown in the flow diagram of FIG. 22. The selections may be displayed on the screen 296 adjacent the selection switches 298, 300, 302, 304, respectively.

The Diagnostic or Test Menu allows the operator to perform troubleshooting on the system. Selecting the Test Menu by the pressing the fourth selection switch 304 while the main menu appears on the screen 296 (or automatically on the basis of the operator's identification information) presents the operator with the selections illustrated in the flow chart of FIG. 23. Each selection is displayed adjacent a corresponding one of the selection switches 298, 300, 302, 304.

Figures 23, 24:
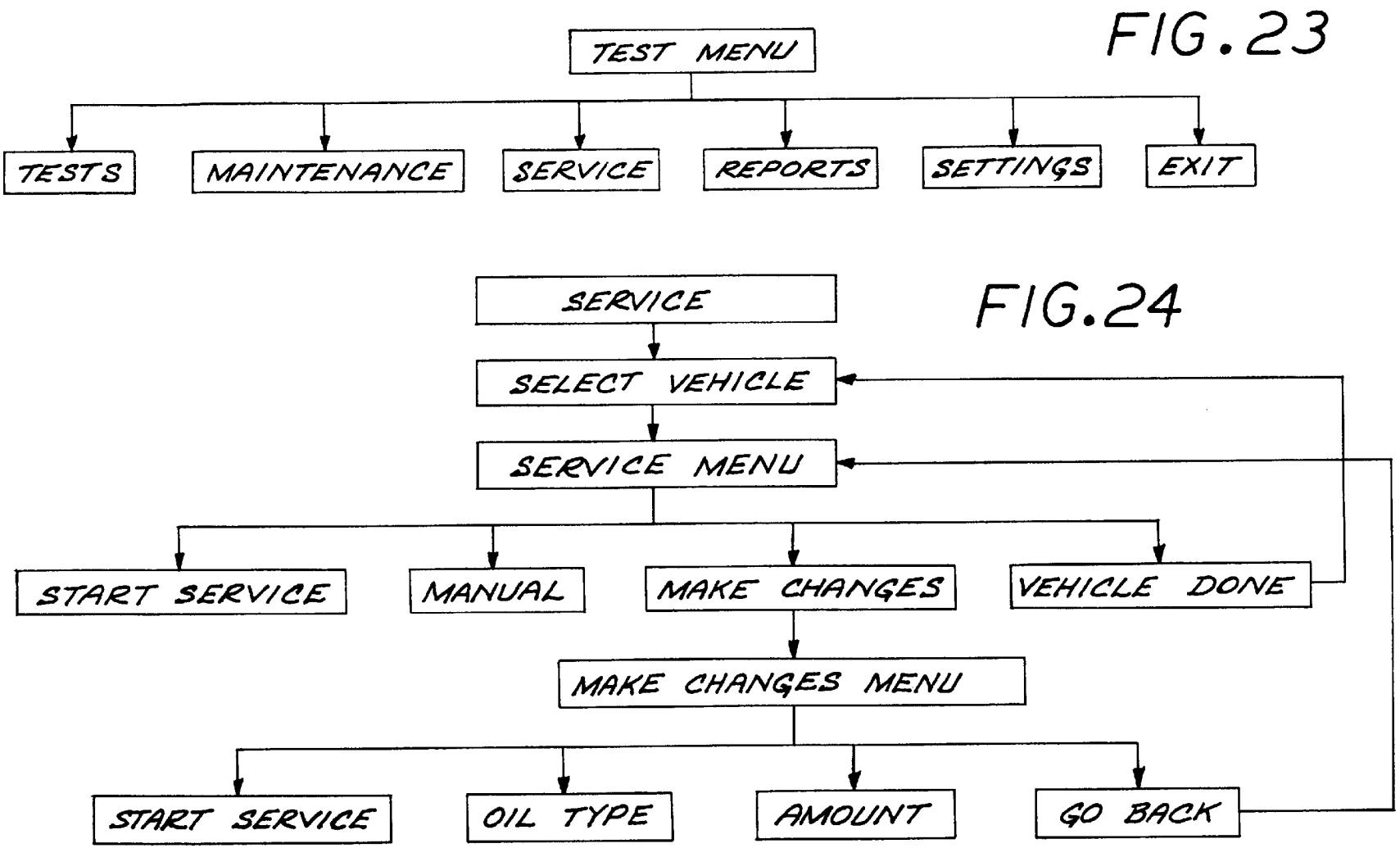
FIG. 23 is a block diagram of the beginning steps of the Test or Diagnostic segment of the method of the present invention.
FIG. 24 is a block diagram overview of the Service segment of the method of the present invention.

The flow diagram of FIG. 23 shows six options for the Test Menu. However, the control panel 292 includes only four selection switches. Therefore, the microprocessor 132*a* may be programmed to display only some of the options, such as the Tests, Settings, Reports, and Exit options. The Service and Maintenance menus may be accessed from the Mechanic Menu or the Manager Menu.

SERVICE MENU

If the operator selects the Service option from the Mechanic Menu or the Manager Menu, the screen 296 prompts the operator to select a vehicle by entering vehicle identification information. The microprocessor 132*a*, by accessing the vehicle identification database stored on the memory 305, determines from the vehicle identification the quantity and type of lubricating fluid or oil to be injected into the vehicle engine. Thus, using the information stored in the system database, the system automatically determines the type and quantity of lubricating fluid to be injected into the vehicle engine. The operator does not have to determine the fluid quantity or type, or enter the fluid quantity and type each time the vehicle is serviced.

The vehicle identification may be an identification of a type of vehicle or engine, or may be a unique identifier for a specific vehicle or engine. Using a unique vehicle or engine identification permits the system to track the service record of that particular vehicle or engine. The vehicle identification information may be entered using the key pads 213, 214 on the control panel 292. Alternatively, the bar code reader 216 may be used to scan an identification sticker on the vehicle that contains the vehicle identification information.

The database of vehicle identification information may be constructed by the operator to reflect the vehicles the system is to service. For example, when the system is used in a fleet vehicle maintenance garage, each vehicle maintained by that garage may be assigned a unique number. The database may be constructed by entering the vehicle number and the type and quantity of lubricating fluid to be injected into that vehicle when the fluid is changed. The vehicle number may be any identifying indicia, including its license plate number, its manufacturer's serial number (Vehicle Identification Number or VIN), or a special fleet number. Preferably, additional identifying information is included that can be used by the operator to verify the vehicle. Such additional information is retrieved from the database and displayed on the screen 296 when the operator enters the identification information. For example, after the operator enters the vehicle identification information, the system may display on the screen 296 the make and model of the vehicle, allowing the operator to double check that the identification information has been correctly entered.

Alternatively, the vehicle may be identified by type, such as by make, model, and engine type. This may be useful in an application in which the specific vehicles serviced may continuously change, as in a commercial service facility serving the general public.

Once the vehicle identification information has been entered, the microprocessor causes the screen 296 to display options available for the operator. In the exemplary embodiment illustrated in FIG. 24, four options are presented. Each option may be displayed next to a corresponding one of the selection switches 298, 300, 302, 304. The operator may choose to start the Automatic Service operation by depressing the selection switch adjacent the display Start Service. Alternatively, the operator may select the Manual option to perform certain functions manually. The operator may also make changes to the service parameters using the Make Changes selection, or indicate that service of the vehicle is done by selecting the Vehicle Done option. Selecting the Vehicle Done option returns the system to the Select Vehicle option at the system's next higher level, at which the operator may enter another vehicle identification to perform a service on a different vehicle.

Automatic Service

Figure 25:
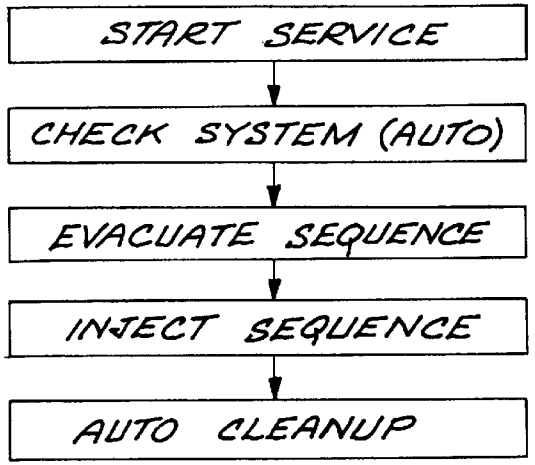
FIG. 25 is a block diagram overview of the Automatic Service portion of the method of the present invention.

The Automatic Service sequence that is performed by the system under the control of the microprocessor 132*a* when the Start Service option is selected is shown in the flow chart of FIG. 25. Throughout the sequence, the system displays on the screen 296 status information pertaining to the system operation.

In the Automatic Service sequence, the system first performs a System Check to check that all necessary parameters are within tolerance. This System Check sequence is shown in the flow diagram of FIG. 30. The system verifies that there is sufficient fresh oil in the fresh oil tank 24, 26 to be able to supply the amount of oil required by the vehicle. The microprocessor 132*a* determines from a comparison of the vehicle identification with the information in the system database the type of oil to be injected into the vehicle's engine, and the quantity to be injected. The microprocessor 132*a* selects the fresh oil tank 24, 26 containing the desired type of oil, and determines from the reading taken from the pressure transducer 241*a*, 241*b* in the fresh oil tank 24, 26 containing the type of oil to be delivered to the identified vehicle whether the selected tank contains sufficient oil to perform the oil change operation. As noted above, the pressure transducers 241*a*, 241*b* in the fresh oil tanks 24, 26 provide pressure readings to the microprocessor 132*a*. The microprocessor 132*a* converts the pressure readings from the pressure transducers into volume information indicating the quantity of oil in each tank.

The waste oil tank 28 is also checked to ensure that it is not too full to receive the quantity of waste oil expected to be evacuated from the vehicle. The microprocessor determines from a comparison of the vehicle identification with the information in the system vehicle identification database the quantity of waste oil that is likely to be removed from the vehicle engine. The microprocessor converts the reading from the pressure transducer 242 in the waste oil tank 28 into a quantity reading, to determine if the waste oil tank 28 is too full to receive the oil to be evacuated from the vehicle engine.

The vacuum sensor, or vacuum transducer 284 is checked for proper operation. Similarly, the pressure sensor or pressure transducer 271 is checked The operation of the power supply (battery or AC to DC converter) is checked.

The programmed microprocessor 132*a* sets the valves 68, 70, 72 to permit the pump 76 to evacuate the used oil from the engine 152. The settings of the valves 68, 70, 72 are verified for correct settings to begin the Evacuation sequence. An elapsed time timer is started.

Evacuation

The microprocessor 132*a* then causes the system to perform the Automatic Evacuation sequence. The Evacuation sequence is shown in detail in FIGS. 35*a* and 35*b*.

In the Evacuation sequence, the system is initialized by setting the evacuated quantity counter to zero, initializing the vacuum sensing logic, and setting the flag that indicates a full hose. The evacuated quantity counter measures the total fluid evacuated during an Evacuation sequence. The pump 76 is turned on, as is the red "Evacuate" LED 106. The pump timer sets the stroke speed of the pump 76. For example, the pump may have a stroke time of ½ second. The default setting for the Evacuation sequence is to evacuate oil until the crankcase 154 of the engine 152 is empty. Other options, such as withdrawing only a set quantity of oil may be set by the operator, using the Settings menu.

Throughout the Evacuation sequence, the outputs of the system components, including the valve settings, are monitored for correct operation. The process periodically checks that the STOP key on the control panel 292 has not been pressed.

A vacuum timer is used to verify that an appropriate sub-atmospheric pressure (which may be conveniently referred to as a vacuum) is achieved in the evacuation line 71 within a reasonable time once the pump 76 is started. If an appropriate vacuum has not been achieved within the time to which the timer is set, the system assumes there is a leak or other malfunction that is preventing it from establishing the necessary vacuum. In that event, the system stops, and displays an error message. Error messages may be displayed on the display screen 296 of the control panel 292. The vacuum transducer 284 is monitored for verifying the presence of the appropriate sub-atmospheric pressure (vacuum).

Once an adequate vacuum level is achieved, a failsafe timer is started. The failsafe timer is used to ensure that no operation proceeds for an unreasonably long time without an expected result occurring. For example, the failsafe timer is used to ensure that the pump does not continue operating without oil flowing through the evacuation line. If the time to which the failsafe timer is set passes without the fluid flow counter 78 detecting that oil is flowing, the system assumes that a problem has occurred, stops the system operation, and displays an error message. Thus, each time the flow counter 78 produces a pulse indicating fluid flow, the failsafe timer is reset. The flow counter 78 produces a pulse or signal when it detects the passage of a predetermined quantity of fluid.

When the vacuum transducer 284 detects that the vacuum has dropped below a predetermined threshold, the system determines that all the oil has been removed from the crankcase 154. At that time, the pump speed of the pump 76 is increased, and a "clear hose" timer is started. The increased pump speed creates a sub-atmospheric pressure in the hose to pull the oil remaining in the hose 77 into the waste oil tank 28. During this operation, the outputs are still monitored for correct operation. As with all operations, the system continuously verifies that the operator has not pressed the STOP switch on the control panel 292.

Once the "clear hose" timer has expired, the atmospheric vent valve 62 is opened while the pump 76 is cleared. A timer is set to establish the time for clearing the pump.

The total volume of oil evacuated may be noted by the evacuated quantity counter. This quantity may be stored in the system database for later reporting. The evacuated quantity of oil may be desirable to verify that the waste tank 28 contains all the oil evacuated from the serviced vehicles, or to compare with the quantity of fresh oil injected into vehicles serviced by the system.

Injection

Figure 36:
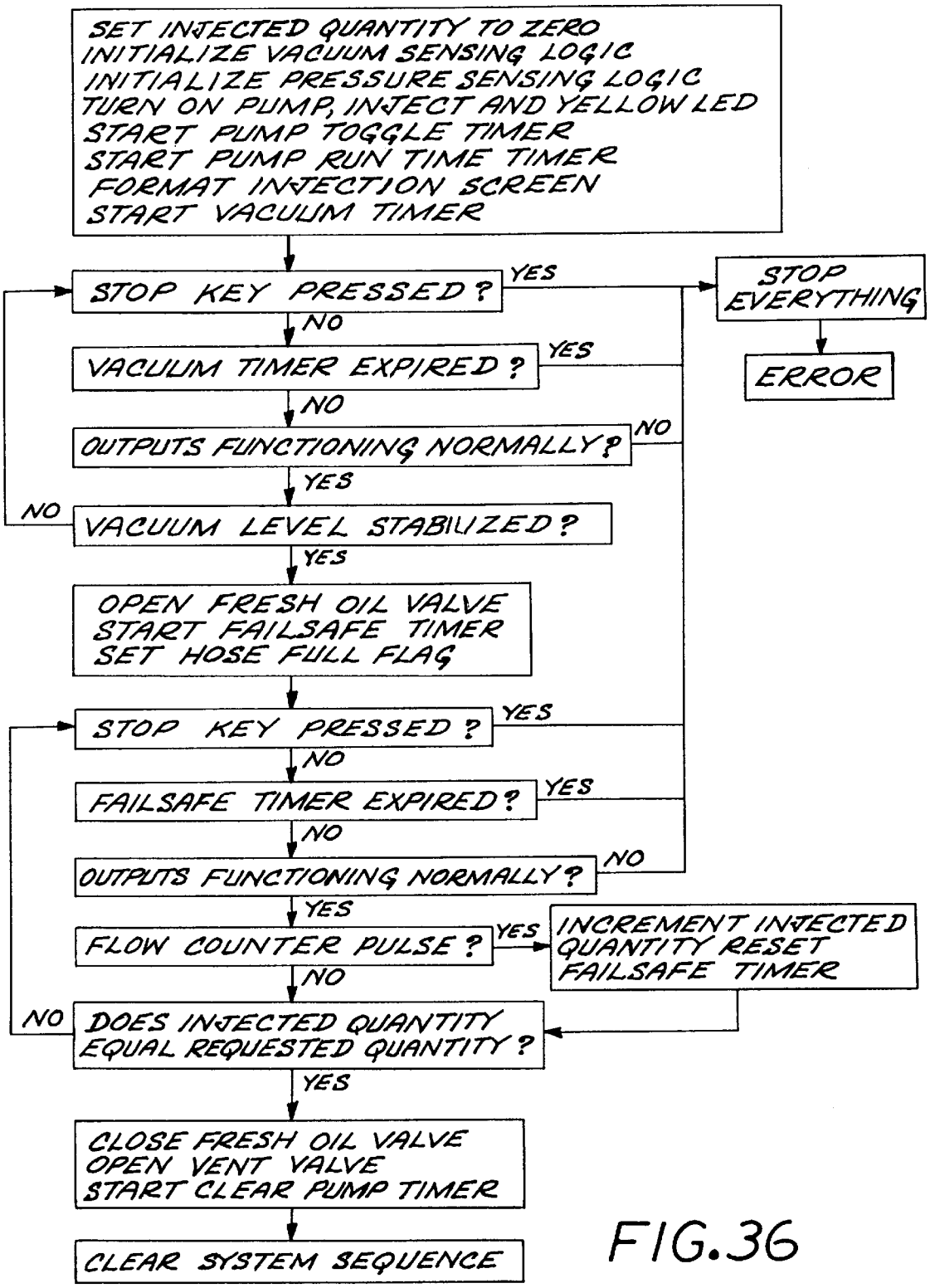
FIG. 36 is a block diagram illustrating the Fluid Inject sequence that may be followed by the present invention.
Figure 37:
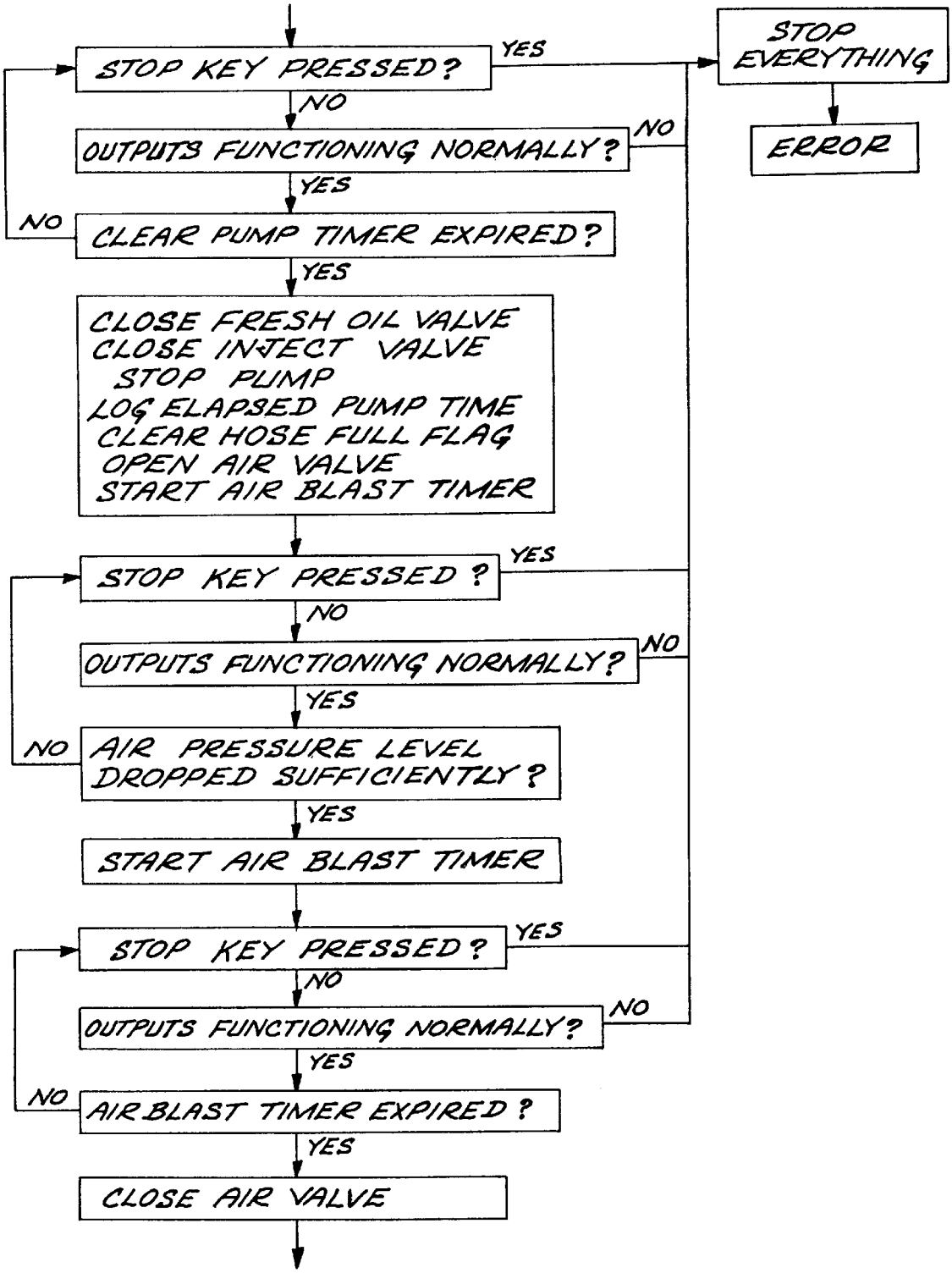
FIG. 37 is a block diagram illustrating the Clear System sequence followed by the present invention.

Once the Evacuation sequence is completed, the Inject sequence is followed to inject fresh oil from one of the fresh oil tanks 24, 26 into the crankcase 154 of the engine 152. FIG. 36 is a detailed flow diagram of the Inject sequence.

During the Inject sequence, the microprocessor 132*a* causes fresh oil from the selected one of the fresh oil tanks 24, 26 to be supplied through the pump 76 to the conduit 73 leading to the vehicle engine 152 by controlling the valves 64, 66, 68, 72. This selection is made in response to information read from the database stored in the system memory 305 that has been accessed by the microprocessor in response to the vehicle identification supplied to the microprocessor. The microprocessor causes a predetermined quantity of oil to be pumped through the pump 76, as measured by the pulse flow meter counter 78. The predetermined quantity of oil to be delivered to the vehicle is also determined by the microprocessor accessing stored information associated with the vehicle identification.

Thus, once the operator enters a particular vehicle identification number, the microprocessor accesses its stored database to determine the type and quantity of oil to be delivered or injected into the engine for that vehicle, and sets the valves 64, 66 in the appropriate way to deliver the correct type of oil to the conduit 73 for delivery to the vehicle. In addition, the pulse flow meter counter 78 is set so that the pump 76 is caused to stop pumping oil to the conduit 73 when the predetermined quantity of oil has been delivered.

As shown in FIG. 36, the system is initialized for the Injection sequence. The injected quantity counter is set to zero, and the vacuum and pressure sensing logic sequences are initialized. The yellow "Inject" LED 108 on the control panel 292 is illuminated. Timers are set and started. The screen 296 is set to display system status throughout the Inject sequence.

The valve 64, 66 for the tank 24, 26 containing the type of oil to be injected into the engine is opened. The microprocessor 132*a* determines the type and quantity of oil to be injected. Therefore, the operator does not need to separately enter the oil type and quantity. The microprocessor determines that information from the vehicle identification. This automatic determination speeds the process of changing the oil, and reduces the possibility of error in selecting the type and quantity of oil to inject to the engine.

The vacuum timer is set to verify that a vacuum is achieved in the manifold 69 within a predetermined time with the pump 76 running, before the valve 64, 66 for the selected fresh oil tank 24, 26 is opened. If the vacuum timer expires without an appropriate vacuum being achieved, the system determines that there has been a malfunction, stops operation, and displays an error message. An inability to achieve an appropriate vacuum may indicate a leak in the system.

Once an appropriate vacuum level has been stabilized, the valve 64, 66 for the selected fresh oil tank 24, 26 is opened to allow the pump 76 to draw the selected type of fresh oil into the manifold 69, and deliver the oil through the hose 77 to the crankcase 154. The flow counter 78 generates a pulse for each predetermined unit of oil that flows through it. The output of the flow counter 78 is monitored until the appropriate quantity of oil has been injected, at which time the fresh oil valve 64, 66 is closed. The failsafe timer is used to ensure that if the flow counter 78 does not detect oil flowing, the system operation is halted. So long as the flow counter 78 continues to detect the flow of oil, the failsafe timer is reset. The system is calibrated so that the fresh oil valve 64, 66 is closed shortly before the flow counter 78 has measured the full amount of oil to be injected into the engine, to account for the oil that is in the conduit upstream of the flow counter 78.

Once the fresh oil valve is closed, the atmospheric vent valve 62 is opened, and the pump 76 is run for a predetermined time to clear the pump and conduit of fresh oil, so that the full measure of fresh oil is delivered to the crankcase 154. The quantity of oil delivered, as measured by the pulse flow meter counter 78 is stored in the system database, for later reporting.

Finally, once the Inject sequence is completed, the Clear System sequence is implemented. During the Auto Cleanup sequence, compressed air is blown through the conduits to clean out residual oil from the conduit 73. Such cleanup ensures that the full intended quantity of oil is provided to the engine 152. Cleaning out the conduits of residual oil also ensures that the next engine to be serviced does not receive an improper oil type. The Clear System sequence shown in FIG. 37.

In the Clear System sequence, the fresh oil valves 64, 66 remain closed. After the "clear pump" timer has expired, indicating that the full measure of fresh oil has been delivered, the oil inject valve 72 is closed to close off the hose 77. The pump 76 is turned off, and the time the pump has been run is noted and stored in the system database. The valve 70 is opened so residue from the oil conduits may flow into the waste oil tank 28. The air valve 74 is opened for a predetermined time so the compressor 30 directs a blast of air through the conduits 71, 75. After the air pressure has dropped sufficiently (as measured by the pressure transducer 274), the "air blast timer" is restarted to measure a predetermined period of time, after which the air valve 74 is closed.

Manual Options

Figure 26:
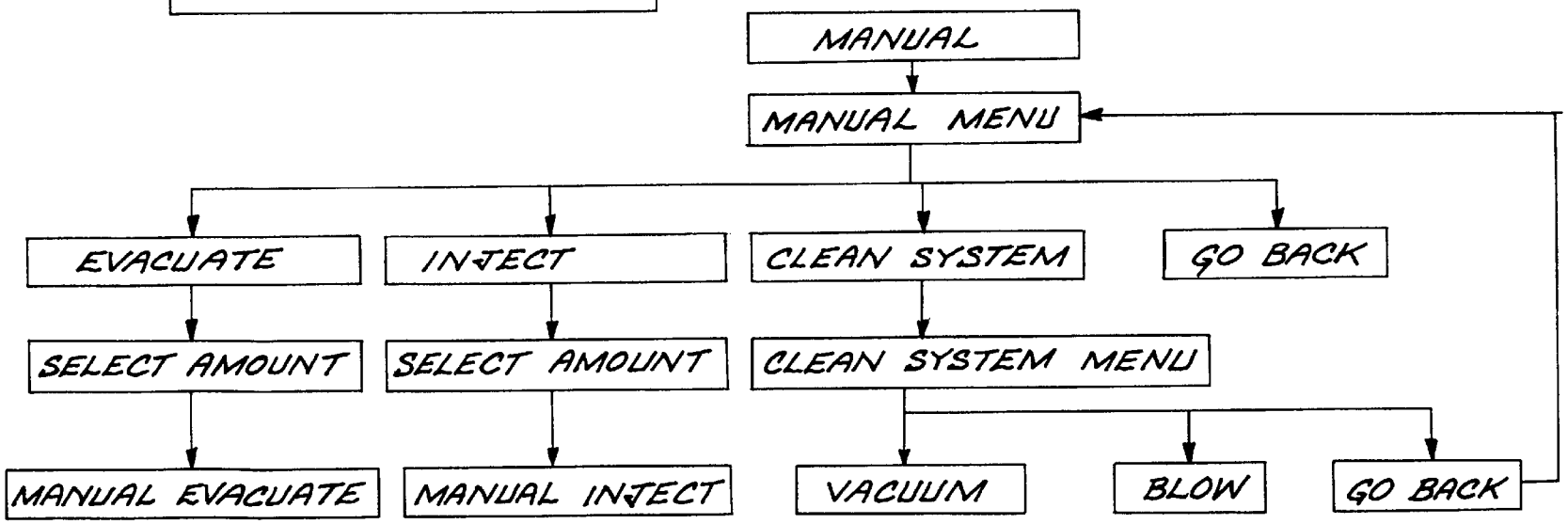
FIG. 26 is a block diagram overview of the Manual Service procedures available in the method of the present invention.

If at the Service menu (FIG. 24), the operator selects the Manual option, the operator can perform a manual evacuation sequence, a manual injection sequence, or clear the system, independently of any other operation. Some of the available sequences and operations are shown in the flow diagram of FIG. 26. When the operator selects the Manual option, the Manual Menu is displayed on the screen 296. The Manual Menu includes the options Evacuate, Inject, Clear System, and Go Back (or Exit), as shown in FIG. 26. Each option is displayed adjacent a corresponding selection switch 298, 300, 302, 304.

Manual Evacuation

Figure 32:
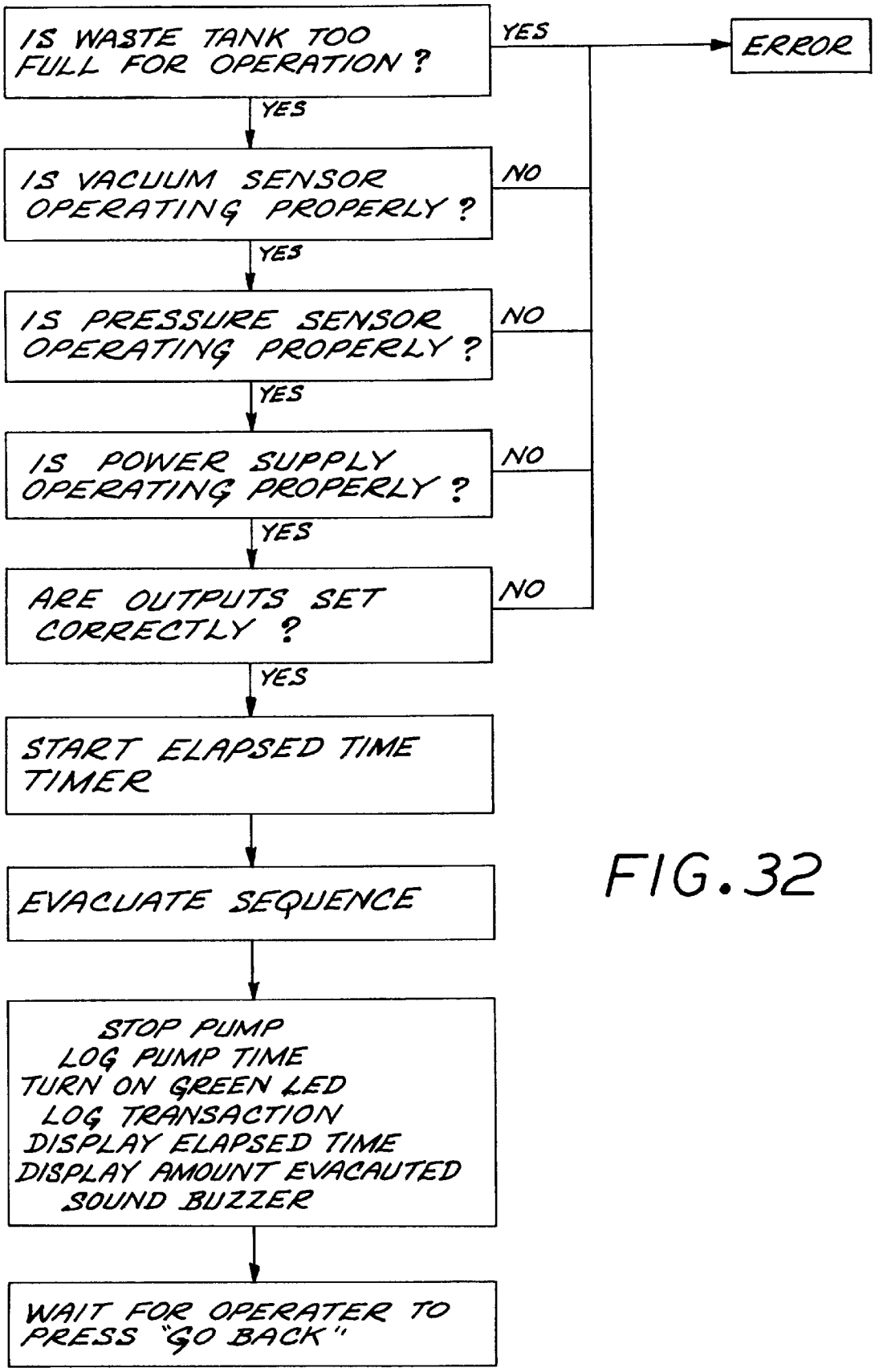
FIG. 32 is a block diagram illustrating the manual Fluid Evacuate sequence that may be followed by the present invention.

In the manual evacuate sequence shown in FIG. 32, the output of the pressure transducer 242 in the waste oil tank 28 is monitored to verify that the waste tank is not too full. The vacuum transducer 284 and the pressure transducer 274 are monitored for proper operation, as is the power supply. The evacuation sequence proceeds as shown in the flow chart of FIGS. 35*a* and 35*b*, and described above. The default evacuation sequence withdraws all the oil from the engine crankcase 154. If the operator desires to withdraw or evacuate only a specific quantity of oil, the operator may select that option from the System Settings menu. In that case, the evacuate operation is stopped when the predetermined quantity of oil has been evacuated.

Once the evacuation sequence is completed, the pump 76 is turned off, and the time the pump operated is displayed on the screen 296 of the control panel 292 The time the pump operated is stored in the system database, as is the evacuation event. The green LED 110 on the control panel 292 is illuminated, and an audible warning is sounded to alert the operator that the operation has been completed. The system awaits further instruction from the operator. The operator selects the Go Back option to return to the selection menu.

In circumstances in which a set amount of fluid is withdrawn, after the flow counter has measured the specified fluid, system configures the valves so that the pump returns fluid that is in the hose and conduit between the engine 152 and the fluid flow meter 78 to the engine.

Manual Inject

Figure 33:
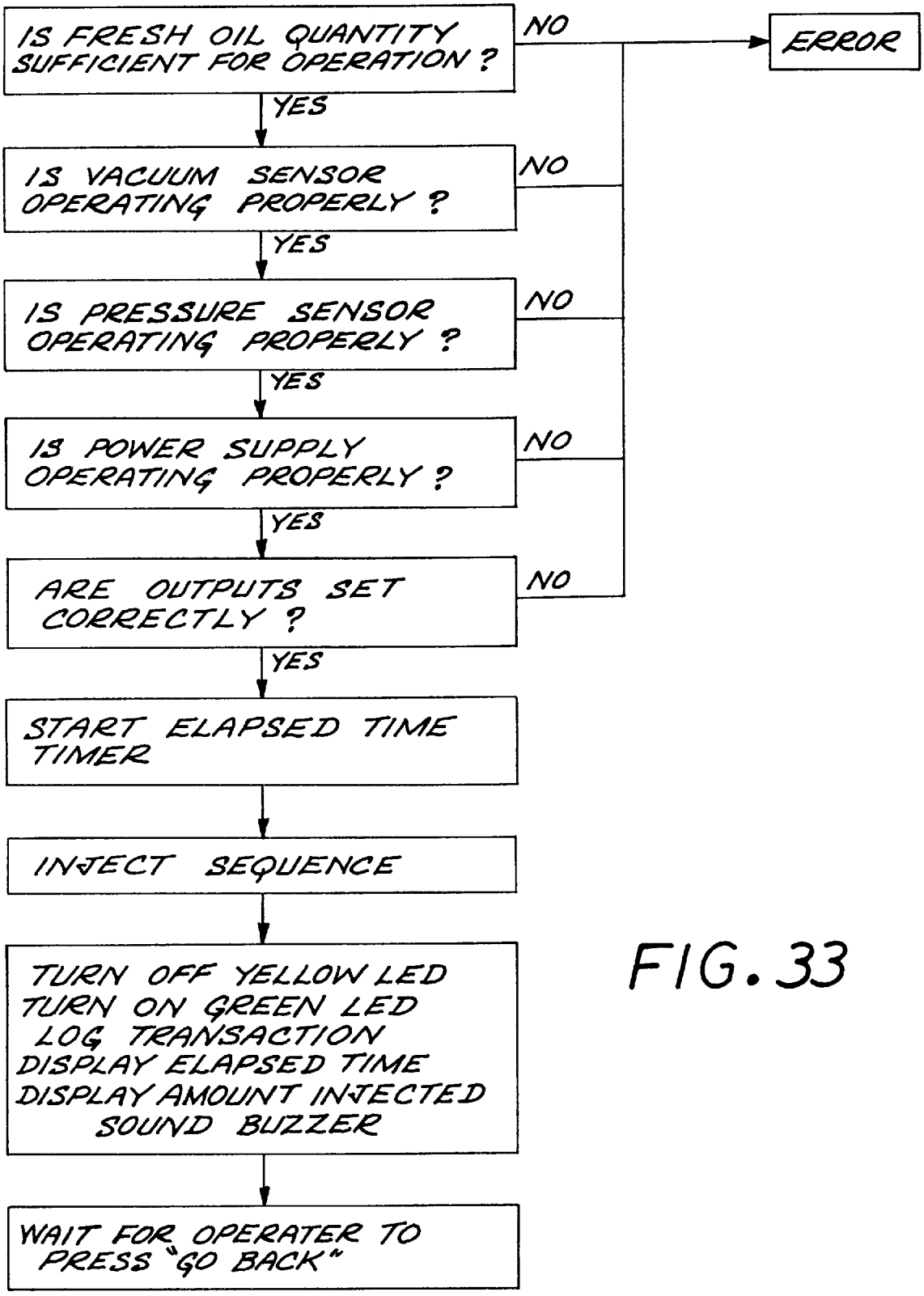
FIG. 33 is a block diagram illustrating the manual Fluid Inject sequence that may be followed by the present invention.

A detailed flow diagram of the Manual Inject sequence is shown in FIG. 33. In the Manual Inject sequence, the output of the pressure transducer in the selected fresh oil tank 24, 26 is monitored to determine that there is sufficient fresh oil available for the oil inject operation. Again, the system automatically determines the type and quantity of oil required for the Inject operation by comparing the vehicle identification information with the information stored in the system database. The default operation is to inject the full measure of oil identified for the selected vehicle. If the operator desires to "top off" the fluid level in the vehicle by only injecting a partial amount, the operator selects that option from the System Settings menu.

The vacuum transducer 284 and the pressure transducer 274 are monitored for proper operation, as is the power supply. The Inject sequence shown in FIG. 36 is then followed. The Inject transaction is recorded in the system database, and displayed on the screen 296. At the conclusion of the Inject sequence, the operator is notified with the LED's 108, 110 and an audible signal, such as a buzzer. The system waits for the operator to make another selection by returning to the system menu.

Clear System

At the Manual Menu, the operator may also select the Clear System option. If Clear System is selected, the microprocessor is programmed to display on the screen 296 additional options from which the operator is to select. The operator may select whether the system is to blow compressed air from the air compressor 30 through the conduits to blow oil remaining in the conduits out of the system through the hose reel 77 (the Blow sequence), or to apply a vacuum to suck the remaining oil into the waste tank 28 (the Clear System Vacuum sequence).

Figure 31:
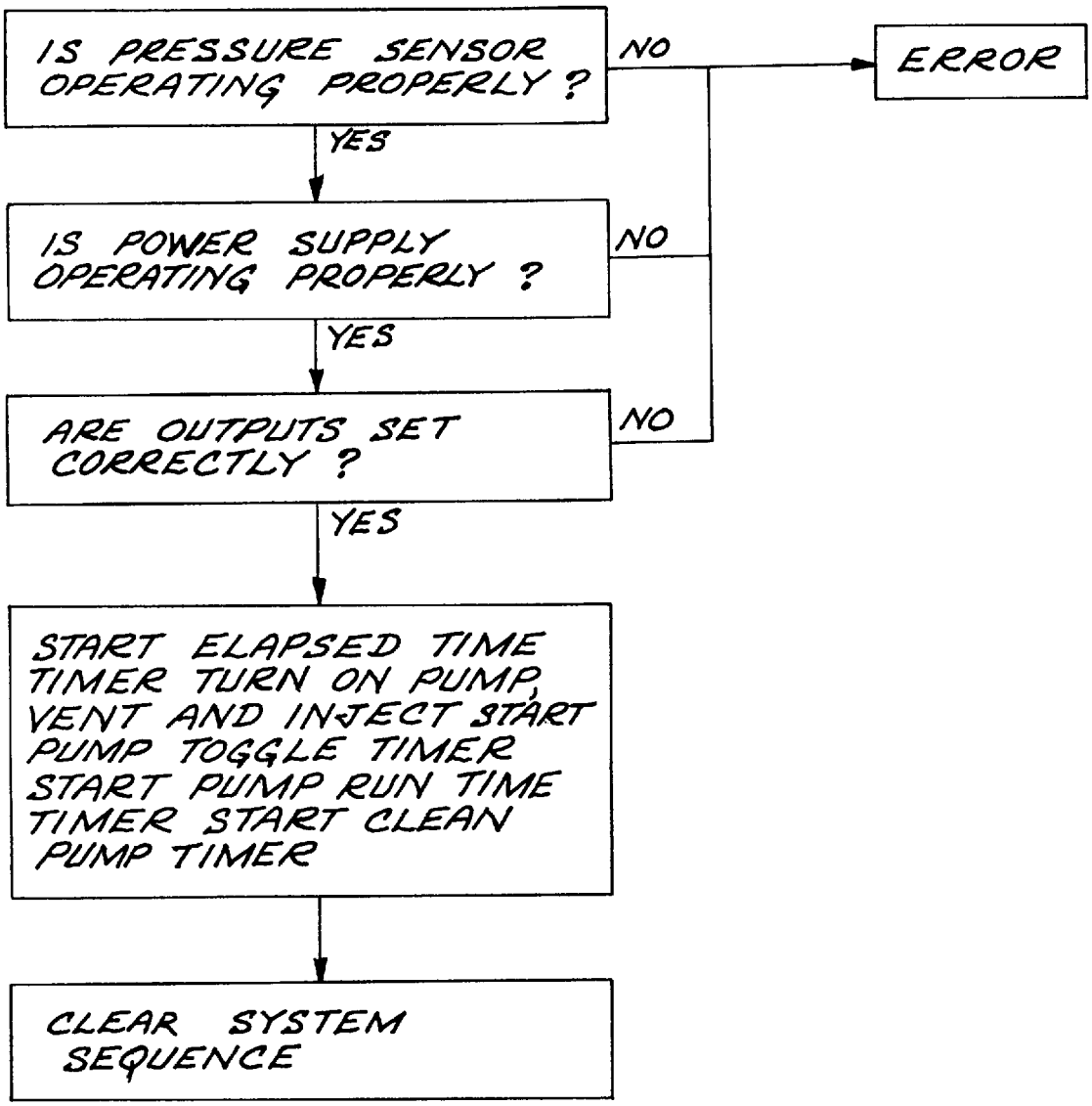
FIG. 31 is a block diagram of the manual Blow sequence that may be performed by the present invention.

A flow chart for the Blow sequence is shown in FIG. 31. The operation of the pressure sensor or transducer 274 is verified, as is the operation of the system power supply. The outputs of the valves are checked to verify that the valves are set to direct oil in the conduits through the hose 77 and out of the system. Among the settings, the atmospheric vent 62 is opened so that the system can draw in atmospheric air. The pump 76 is started and the Clear System sequence shown in FIG. 37 and described above is followed to remove any residual oil from the conduits.

Figure 34:
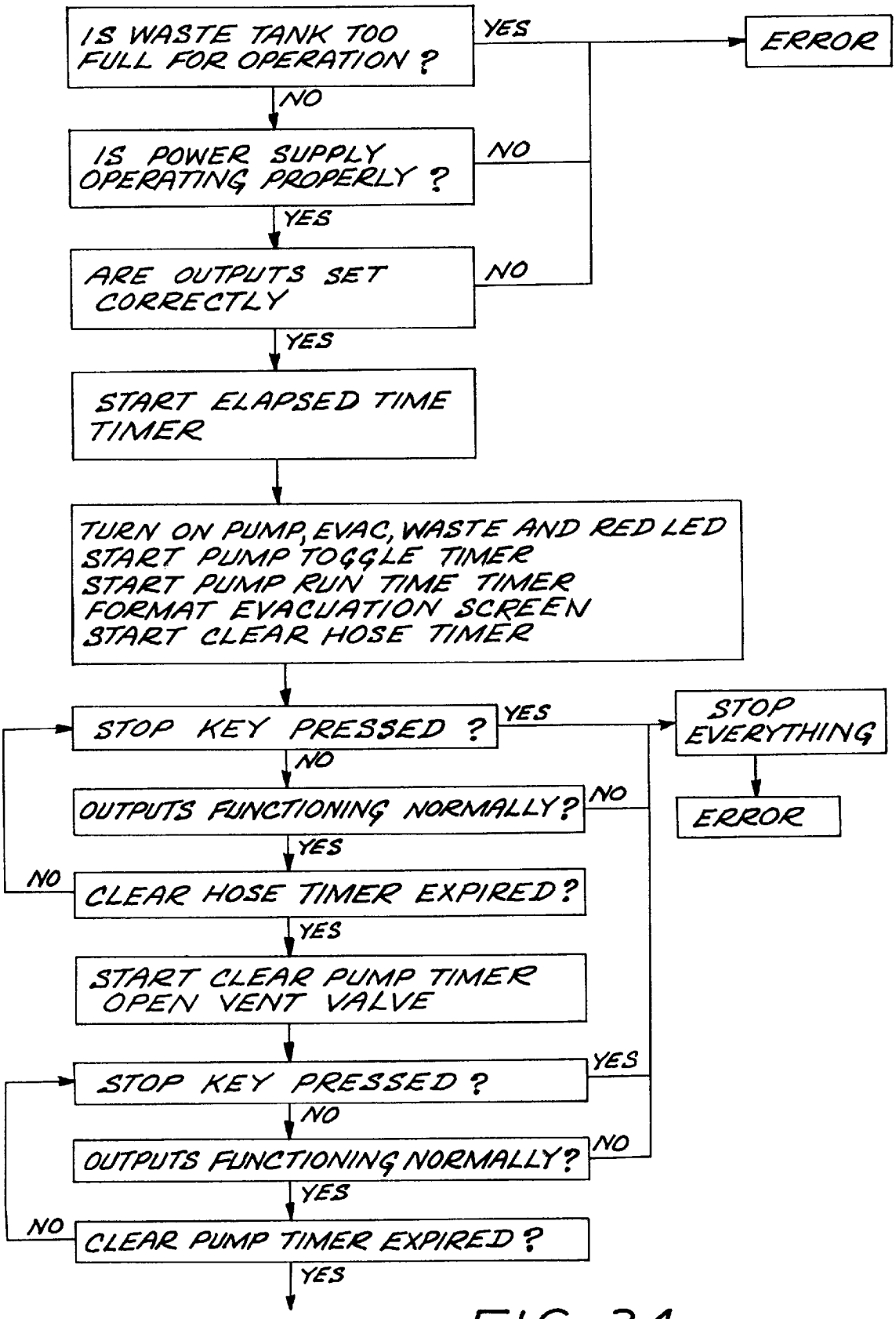
FIG. 34 is a block diagram illustrating the manual Clear System Vacuum sequence that may be followed by the present invention.
Figure 35A:
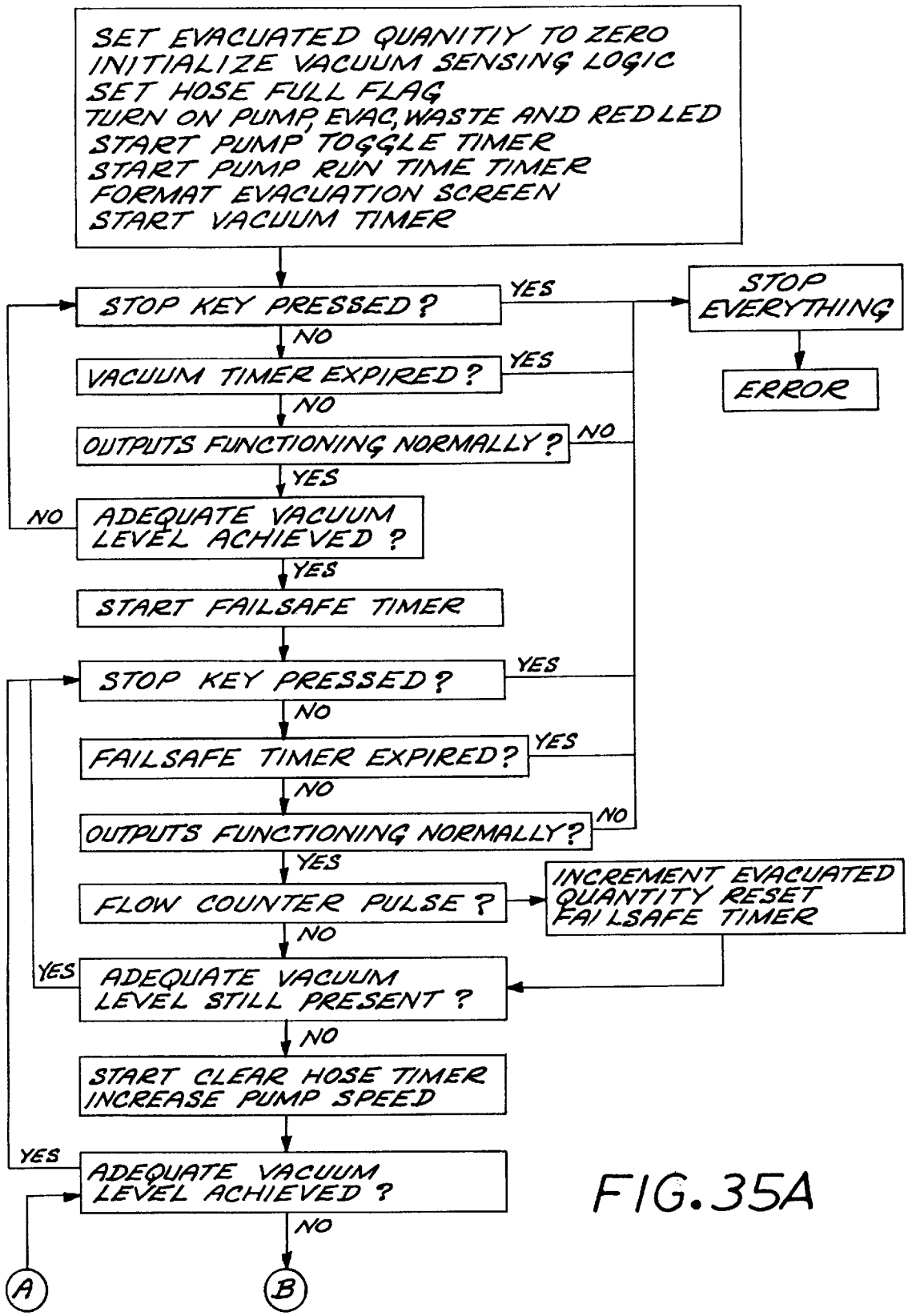
FIGS. 35*a* and 35*b* together constitute a block diagram illustrating the Fluid Evacuate sequence that may be followed by the present invention.
Figure 35B:
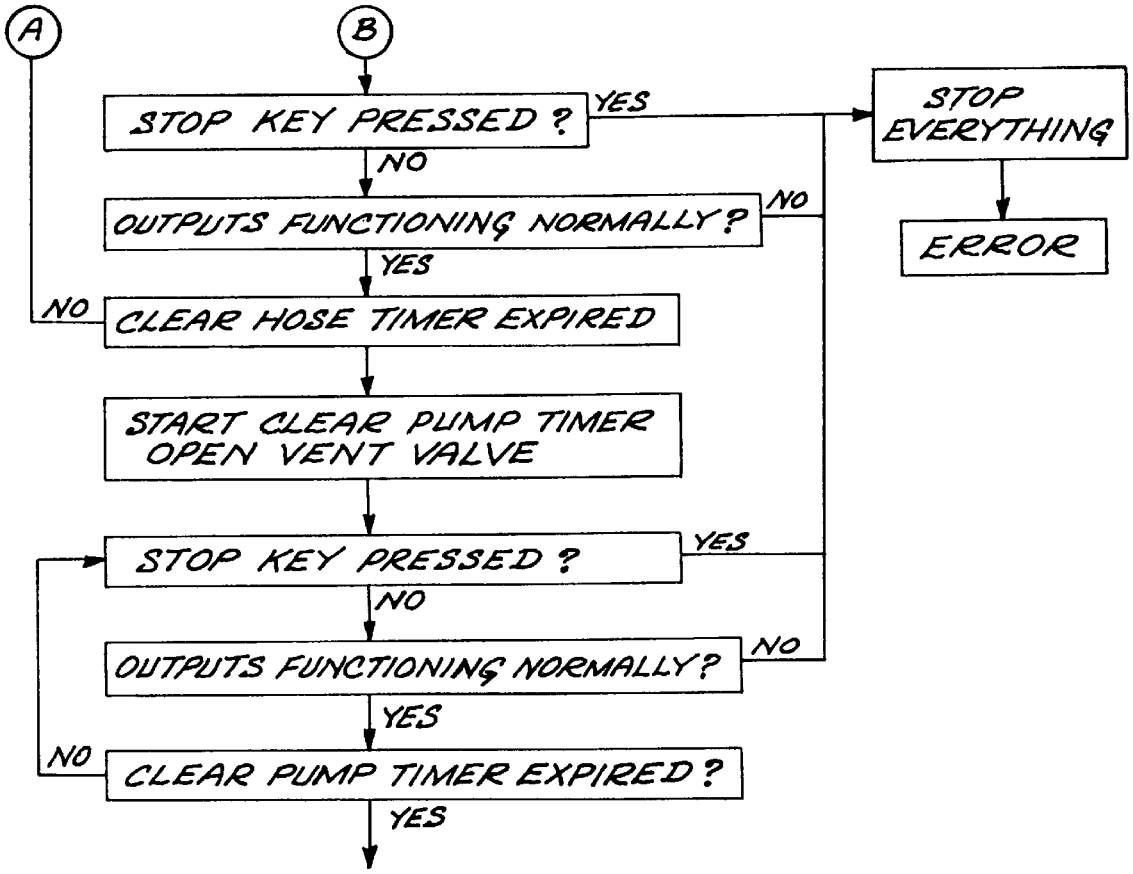

The Clear System Vacuum sequence is shown in detail in the flow chart of FIG. 34. The manual Clear System Vacuum sequence is very similar to the Evacuation sequence shown in the flow diagram of FIGS. 35*a* and 35*b*. The status of the waste tank 28 is verified by monitoring the output of the pressure transducer 242. The correct operation of the power supply is verified, as is the correct status of the valves to direct the residual oil from the conduits into the waste oil tank 28. At the beginning of the Clear System Vacuum sequence, the atmospheric vent 62 is closed so that the pump 76 draws residual oil from the hose 77. This is continued for the time set by the Clear Hose Timer. At the conclusion of that time, the atmospheric vent 62 is opened so that air is drawn in from the vent 22, and the pump is cleared for the time set by the Clear Pump timer.

Make Changes Options

The Make Changes menu allows the operator to make changes to the service parameters. The Make Changes menu and its options are also shown in FIG. 24.

The operator may select to change the oil type that is to be supplied to a particular vehicle, or the quantity of oil to be supplied. If the operator changes the oil type, the microprocessor responds by changing the valves 64, 66 to cause fresh oil from a different one of the fresh oil tanks 24, 26 to be dispensed into the vehicle 150. A change in the oil quantity or oil amount causes the microprocessor to change the threshold measured by the pulse flow meter counter 78 at which the microprocessor causes the pump 76 to stop pumping oil from the fresh oil tanks 24, 26 to the vehicle 150. In addition, the parameters of the Evacuate sequence may be changed so the system evacuates a predetermined quantity of oil, rather than all the oil in the crankcase.

The microprocessor may be programmed to permit the changes to be made either permanently or on a onetime basis. Particular security levels may be established to limit which operators may make changes, and what types of changes they may make. The system may be programmed so that all changes are recorded and may be displayed in an "exceptions" report as part of the Reports option.

MANAGER MENUS

The Manager Menu provides access to Reports and Systems Settings (see FIG. 22).

Figure 27:
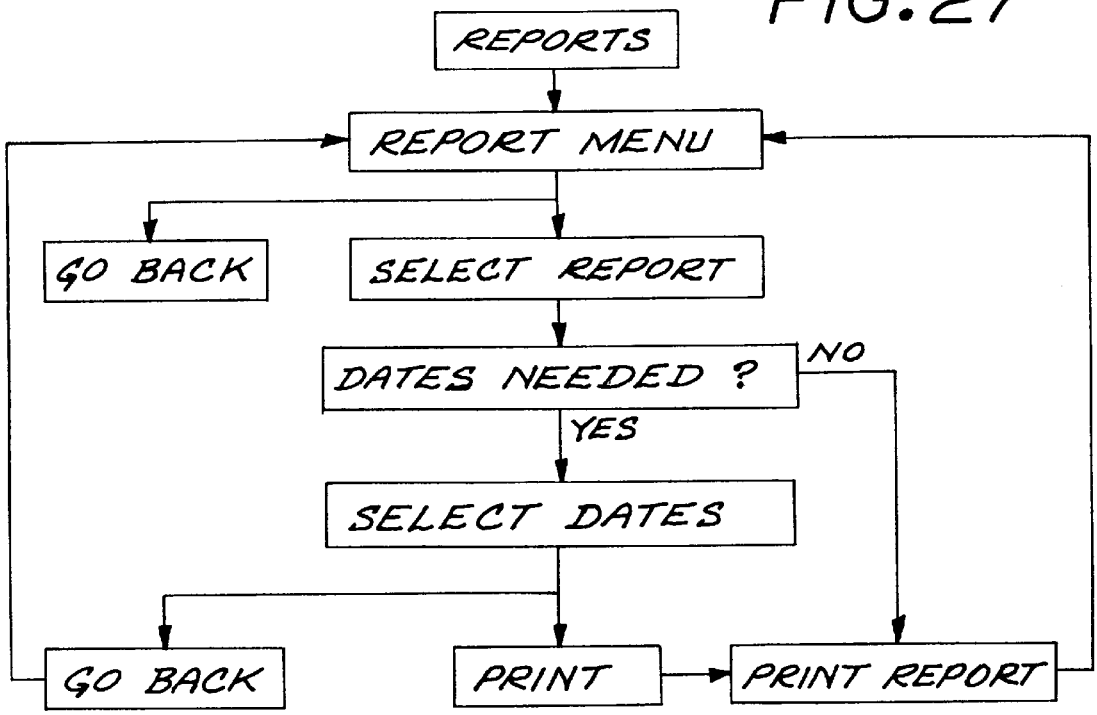
FIG. 27 is a block diagram overview of the steps of the Report segment of the method of the present invention.
Figure 28:
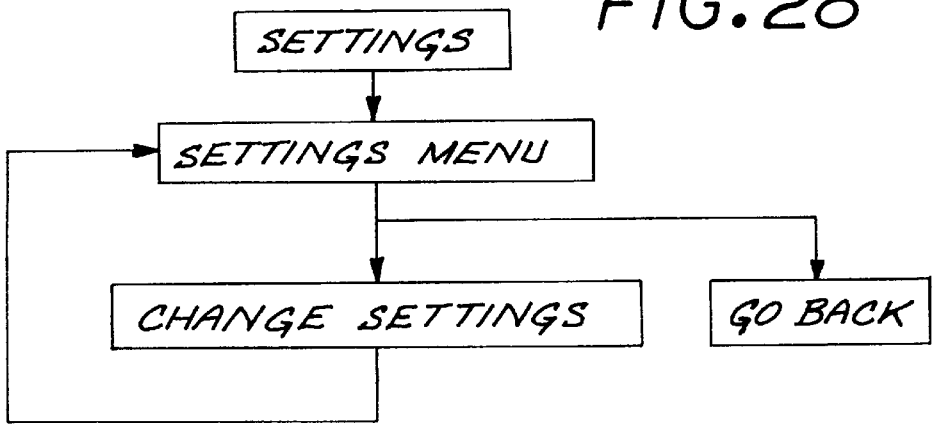
FIG. 28 is a block diagram of a portion of the method of the present invention for changing System Settings.

The operator may select the Reports Menu, which follows the sequence shown in the flow chart of FIG. 27. Once the operator chooses Reports Menu, the microprocessor causes the screen 296 to display a menu showing the types of reports available. As with other menus, a Go Back or Exit option is presented, to permit the operator to backup one stage in the selection process. As with the other menus, each report option is displayed on the screen 296 adjacent a corresponding one of the selection switches 298, 300, 302, 304. The operator selects a report by depressing the corresponding selection switch.

The reports available for the operator to choose from depend on the specific requirements chosen for the system. For example, reports may be available pertaining to the dates on which specific vehicles were serviced. In addition, there may be reports as to which types of vehicles received which types of oil, or the quantities of oil used for different vehicles. The availability of these reports may be particularly useful in the inventory control. These reports allow verification that oil in the fresh oil tanks 24, 26 was properly dispensed into authorized vehicles. In addition, the waste oil removed from vehicle engines may be tracked to verify that appropriate amounts of waste oil are being removed from the vehicles, and to verify that the waste oil tank 28 contains all of the waste oil removed from vehicles.

Additional reports may be generated showing changes entered by different operators in the Make Changes Menu, and operations performed by the different operators. Thus, if an operator in the Service Menu (FIG. 24) makes changes to the settings for a particular vehicle identification, that information may be produced as a report. Such a report permits verification that appropriate changes are made, and the inappropriate changes are not made.

Reports may be displayed directly on the screen 296, or may be directed to an I/O port 295. A printer (not shown) may be attached to the system through the I/O port 295. The printer may be connected to the system using a conventional printer port connection. The printer port connection may be provided through a panel of the system housing.

Selecting the Settings Menu from the Manager Menu causes the microprocessor to display on the screen 296 a menu showing the different system settings that can be changed. The Settings sequence is shown generally in FIG. 28. The settings that may be changed will depend upon the specific system, and in some cases the access level provided to a particular operator. For example, certain simple settings may be provided directly on the display adjacent the selection buttons 298, 300, 302, 304 for direct change. Alternatively, options may be provided that, upon selection, provide additional selections from which the operator may choose. Again, the selection buttons 298, 300, 302, 304 may be used to select the various options as the microprocessor causes them to be displayed adjacent the buttons on the display 296.

DIAGNOSTIC MENU

Figure 29:
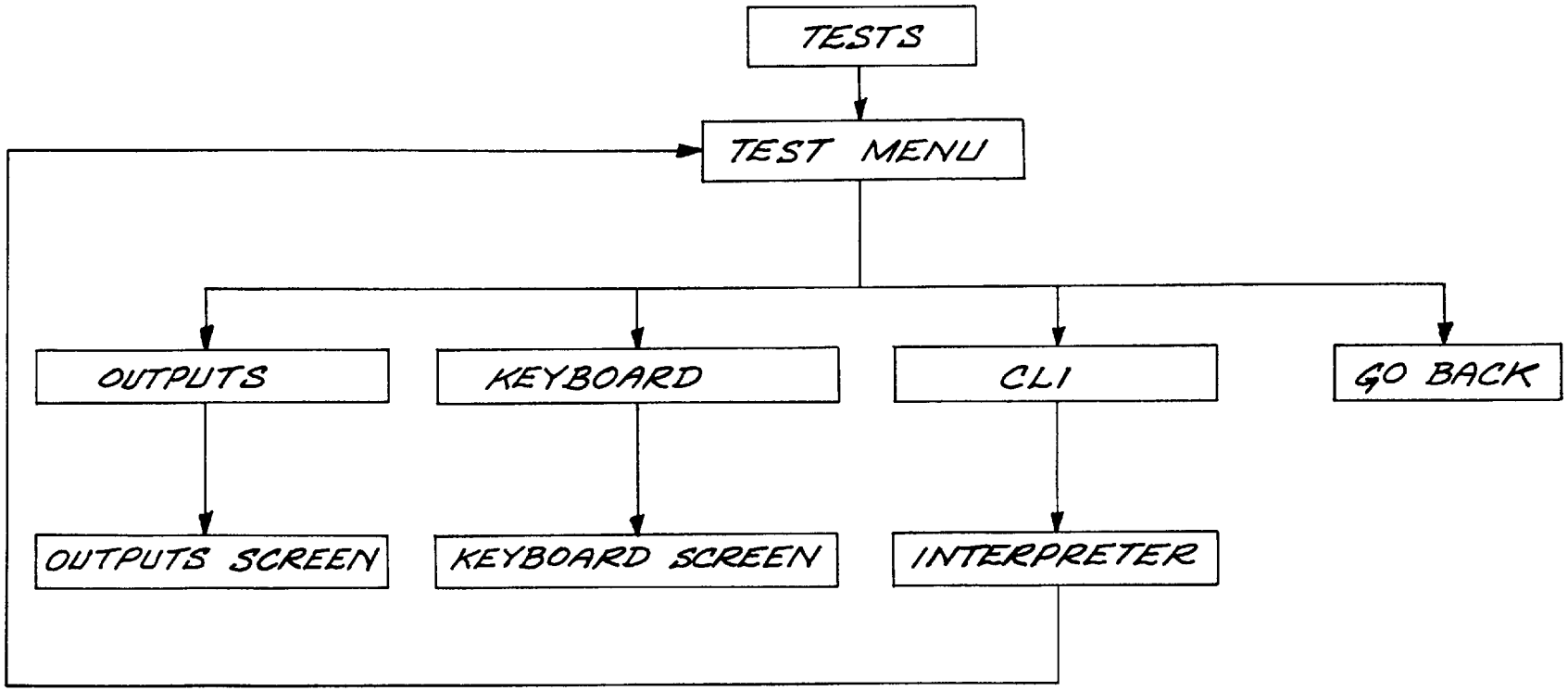
FIG. 29 is a block diagram overview of the system test procedures available in the method of the present invention.
Figure 30:
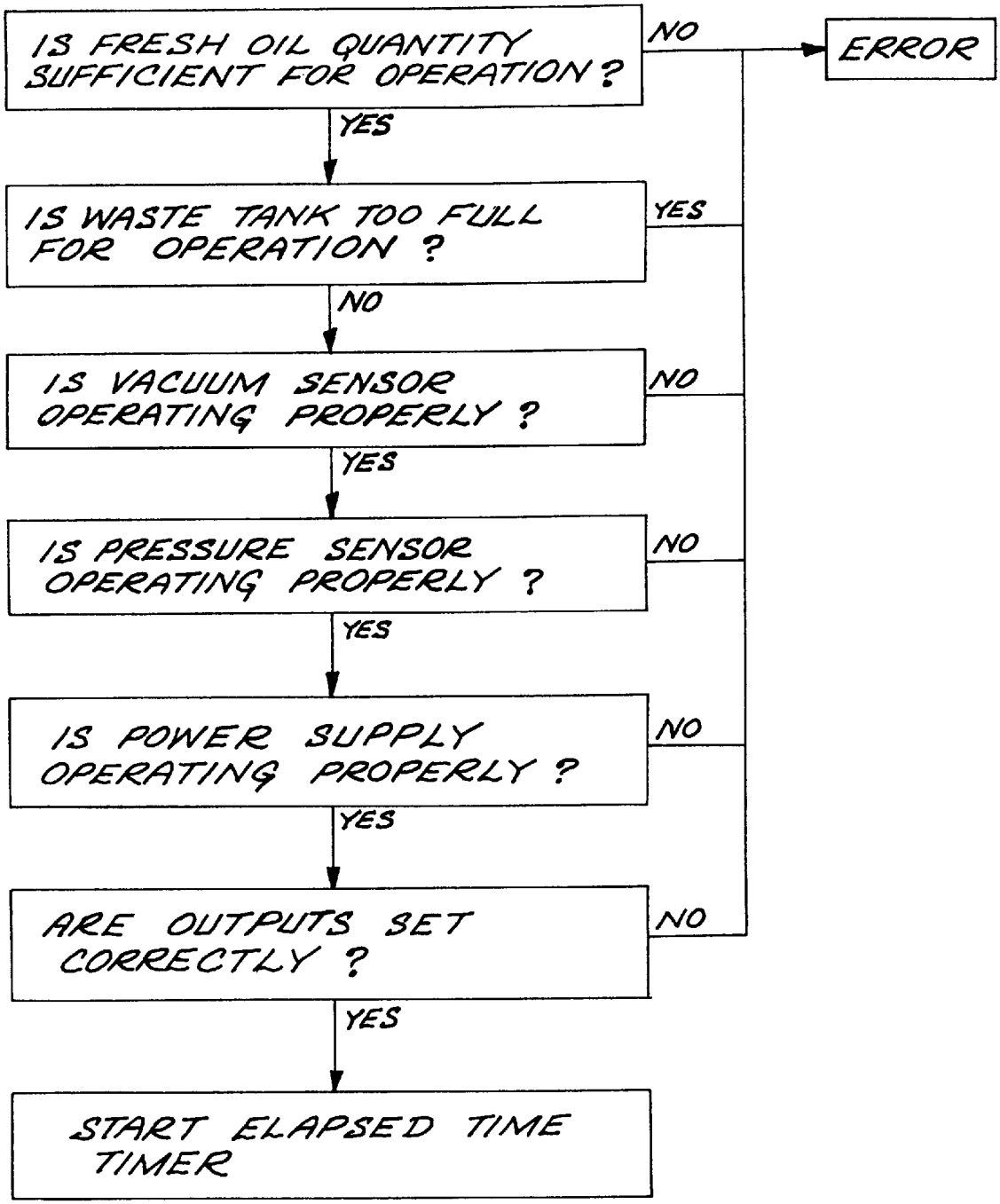
FIG. 30 is a block diagram of the Automatic Check System sequence that may be performed by the present invention.

The Diagnostic Menu or Test Menu that is available by selecting the Tests option under the Test menu selection (FIG. 23) is shown in FIG. 29.

Choosing the Outputs option displays the various system outputs and their state, such as on or off. In addition, the analog input associated with that output may be also displayed. Furthermore, an option to turn the identified output on or off may also be provided. This selection option may be provided using selection switches adjacent the screen 296.

The Keyboard test option causes the microprocessor 132*a* display a grid on the screen 296 that allows the operator to test each key on the keyboard. In an exemplary embodiment, this Keyboard Test sequence does not provide an Exit option. In this embodiment, the system must be turned off by pressing the power switch, and then restarting the system.

The CLI option provides a command line interface for various test functions.

The specific Test functions may be programmed into the microprocessor, and will depend on desired system functions.

As with other menu options, the Go Back option causes the menu display one level higher to be displayed on the screen 296.

The exemplary embodiments of the present invention have been described in the context of exchanging lubricating fluid in an internal combustion engine of a vehicle. It will be apparent that the invention is applicable to any type of fluid exchange. For example, the system can readily be adapted to use to exchange lubricating fluid in industrial machines. In particular, the system and method are useful for any application in which fluid is to be withdrawn and replaced with a predetermined amount of fresh fluid.

Although exemplary embodiments of the invention have been described for the purposes of illustrating the features thereof, it will be appreciated that a number of variations and modifications may suggest themselves to those skilled in the pertinent arts. Such variations and modifications are considered within the spirit and scope of the invention as defined in the claims that follow.

What is claimed is:

1. A system for evacuating used fluid from a fluid reservoir in an apparatus, and for supplying fresh fluid thereto, the system comprising:

a waste conduit;

a source conduit adapted for connection to a source of fresh fluid;

a fitting configured for fluid communication with a fluid reservoir;

a single bidirectional flow conduit in fluid communication with the fitting;

a pump in fluid communication with the reservoir solely through the bidirectional flow conduit;

a plurality of electrically-controlled valves for providing fluid communication selectively between the pump and the source conduit, and between the pump and the waste conduit;

a data input port for receiving data;

a flow meter for producing a flow signal indicative of the volume of fluid flowing through said pump; and a microprocessor programmed to produce selected sequences of control signals to actuate said pump and said electrically-controlled valves in response to the flow signal and data received at said data input port.

2. The system of claim 1, wherein said pump is selectively actuable to produce subatmospheric and positive pneumatic pressure.

3. The system of claim 1, wherein said data includes apparatus identification information.

4. The system of claim 1, wherein said data includes fluid quantity and type information.

5. The system of claim 1, wherein said data input port comprises an alphanumeric keypad.

6. The system of claim 1, wherein said data input port comprises a bar code scanner.

7. The system of claim 1, wherein said data additionally includes operator identification information, and wherein said microprocessor is additionally programmed to produce selected ones of said sequences of control signals in response to said operator identification information.

8. The system of claim 1, wherein said source conduit comprises a plurality of fluid source conduits, each suitable for connection to a separate fluid source, and said microprocessor is additionally programmed so that said selected sequences of control signals actuate said electrically controlled valves to select a particular one of said source conduits in response to data received at said data input port.

9. The system of claim 1, wherein and said microprocessor is additionally programmed to prompt an operator to select from a plurality of said sequences of control signals.

10. A system for evacuating fluid from and injecting fluid into a receptacle, the system comprising:

a receptacle connection configured for establishing a fluid communication with a receptacle;

a waste path suitable for connection to a waste tank;

a source path suitable for connection to a source tank containing fresh fluid;

a series of conduits connecting said source path and said waste path with said receptacle connection, wherein fluid flow through said conduits is controlled by a plurality of electrically controlled valves;

a single bidirectional flow conduit having a first end in fluid communication with the receptacle connection, and a second end;

a pump for selectively producing sub-atmospheric pressure in said series of conduits, said pump being in fluid communication with the second end of the bidirectional flow conduit;

a flow meter for producing a flow signal indicative of the volume of fluid flowing through said conduits;

a data input port for receiving data; and a microprocessor programmed to produce selected sequences of control signals to actuate said pump and said electrically controlled valves in response to said flow signal and to data received at said data input port.

11. The system of claim 10, wherein said data include identification information suitable for identifying said receptacle, and wherein said system additionally includes a database for correlating the identification information with a predetermined set of said sequences of control signals.

12. The system of claim 11, wherein said first receptacle comprises a reservoir of lubricating fluid for a machine, and said identification information includes information identifying said machine.

13. The system of claim 12, wherein said machine comprises an engine in a vehicle, and said identification information comprises vehicle identification information.

14. The system of claim 10, wherein said data additionally include operator identification information, and said microprocessor is additionally programmed to produce certain of said selected sequences of control signals in response to said operator identification information.

15. A system for evacuating fluid from a fluid receptacle, said fluid receptacle having an access opening, and for supplying fresh fluid to said fluid receptacle, the system comprising:

a receptacle connection configured for establishing fluid communication with an access opening in a fluid receptacle;

a waste conduit suitable for connection to a waste tank;

a source conduit suitable for connection to a source tank containing fresh fluid;

a single bidirectional flow conduit having a first end in fluid communication with the receptacle connection, and a second end;

a pump for selectively producing sub-atmospheric pressure, the pump being in fluid communication with the second end of said bidirectional flow conduit; and a valve that selectively provides fluid communication between said pump and said source conduit and between said pump and said waste conduit, so that said waste conduit and said source conduit may be selectively placed in fluid communication with said receptacle connection through said pump and said bidirectional flow conduit.

16. The system of claim 15, additionally comprising a controller for controlling said pump to place, at different times, said waste conduit and said source conduit in fluid communication with said receptacle connection.

17. The system of claim 16, wherein said controller is actuable to cause said valve to be set so that said waste conduit is placed in fluid communication with said pump, and, when a predetermined condition is satisfied, to cause said valve to be set so that said source conduit is placed in fluid communication with said pump.

18. The system of claim 17, wherein said predetermined condition comprises a pressure in the waste conduit that has reached a level indicating that fluid is no longer flowing in said waste conduit.

19. The system of claim 17, wherein:

the system additionally comprises a flow meter for producing a flow signal indicative of the volume of fluid flowing through said waste conduit; and said predetermined condition comprises the passage of a predetermined volume of fluid through the waste conduit.

20. A system for evacuating used lubricating fluid from a fluid receptacle of the a lubricating system, said fluid receptacle having an access opening, and for supplying fresh lubricating fluid to said fluid receptacle, the system comprising:

a waste conduit suitable for connection to a waste tank;

a source conduit suitable for connection to a source tank containing fresh fluid;

a fitting suitable for insertion into an access opening in said receptacle;

a single bidirectional flow conduit having a first end in fluid communication with the fitting, and a second end;

a pump for selectively producing sub-atmospheric pressure, the pump being in fluid communication with the second end of said bidirectional flow conduit;

a plurality of electrically-controlled valves that selectively provide fluid communication between said pump and said source conduit and between said pump and said waste conduit, so that said waste conduit and said source conduit may be selectively placed in fluid communication with said fitting through said pump and said bidirectional flow conduit;

a data input port for receiving data; and a microprocessor programmed to produce selected sequences of control signals to actuate said pump and said electrically controlled valves in response to data received at said data input port.

21. The system of claim 20, additionally comprising a flow meter for producing a flow signal indicative of the volume of fluid flowing through said pump, wherein said microprocessor is additionally programmed to produce said selected sequences of control signals to actuate said pump and said electrically controlled valves in response to said flow signal.

* * * * *